US011754356B2

(12) United States Patent
Müller

(10) Patent No.: US 11,754,356 B2
(45) Date of Patent: Sep. 12, 2023

(54) MAGAZINE APPARATUS FOR SELF-LOADING FIREARMS

(71) Applicant: Heckler & Koch GmbH, Oberndorf/Neckar (DE)

(72) Inventor: Steffen Müller, Herrenzimmern (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 17/376,884

(22) Filed: Jul. 15, 2021

(65) Prior Publication Data

US 2021/0341240 A1 Nov. 4, 2021

Related U.S. Application Data

(63) Continuation of application No. 16/198,474, filed on Nov. 21, 2018, now Pat. No. 11,092,397.

(30) Foreign Application Priority Data

Nov. 24, 2017 (DE) ..... 10 2017 010 908.7

(51) Int. Cl.
*F41A 9/65* (2006.01)
*F41A 9/66* (2006.01)
*F41A 9/69* (2006.01)

(52) U.S. Cl.
CPC ..... *F41A 9/65* (2013.01); *F41A 9/66* (2013.01); *F41A 9/69* (2013.01)

(58) Field of Classification Search
CPC ..... F41A 21/61; F41A 21/64; F41A 21/65; F41A 21/66; F41A 21/69; F41A 9/61; F41A 9/64; F41A 9/65; F41A 9/66; F41A 9/69
USPC ..... 42/7, 49.01, 50
See application file for complete search history.

(56) References Cited

U.S. PATENT DOCUMENTS 2,488,233 A 11/1949 Pelo
4,430,821 A 2/1984 Vincent
5,081,778 A * 1/1992 Switzer ..... F41A 9/66 42/50
5,309,660 A * 5/1994 Blackamore ..... F42B 33/14 42/106

(Continued)

FOREIGN PATENT DOCUMENTS

DE 2919885 11/1980
DE 8609410 5/1986

(Continued)

OTHER PUBLICATIONS

German Patent Office, "Office Action," dated Sep. 10, 2018 in connection with German Patent Application No. 102017010908.7, 14 pages (including translation).

(Continued)

*Primary Examiner* — Joshua E Freeman
*Assistant Examiner* — Benjamin S Gomberg
(74) *Attorney, Agent, or Firm* — HANLEY, FLIGHT & ZIMMERMAN, LLC

(57) ABSTRACT

Example apparatus are disclosed for a magazine for a self-loading firearm, the magazine comprising a magazine housing, and a magazine floor plate movably mounted to the magazine housing. The magazine floor plate is slidable between an open position and a closed position, wherein the magazine floor plate is pivotable relative to the magazine housing when in the open position.

19 Claims, 28 Drawing Sheets

(56) References Cited

U.S. PATENT DOCUMENTS

| | | | | |
|---|---|---|---|---|
| 5,438,783 | A | 8/1995 | Sniezak et al. | |
| 7,497,044 | B2 | 5/2009 | Cammenga et al. | |
| 7,937,872 | B1 | 5/2011 | Fluhr | |
| 8,069,601 | B1 | 12/2011 | Fitzpatrick et al. | |
| 8,225,541 | B2 | 7/2012 | Bigley et al. | |
| 9,103,614 | B2 | 8/2015 | Froehle et al. | |
| 11,092,397 | B2 * | 8/2021 | Müller | F41A 9/66 |
| 2003/0046850 | A1 | 3/2003 | Beretta | |
| 2010/0251590 | A1 | 10/2010 | Fitzpatrick et al. | |
| 2012/0066950 | A1 | 3/2012 | Davidson | |
| 2012/0131830 | A1 | 5/2012 | Froehle et al. | |
| 2012/0233902 | A1 | 9/2012 | McCarthy et al. | |
| 2013/0333261 | A1 | 12/2013 | Clifton, Jr. et al. | |
| 2015/0121736 | A1 | 5/2015 | Faifer | |
| 2015/0276339 | A1 | 10/2015 | Shreve | |
| 2016/0298919 | A1 | 10/2016 | Ballard | |

FOREIGN PATENT DOCUMENTS

| | | |
|---|---|---|
| DE | 102005028603 | 12/2006 |
| DE | 102006011278 | 9/2007 |
| DE | 112008001241 | 4/2010 |
| DE | 102016107479 | 10/2017 |
| EP | 1568962 | 8/2005 |
| EP | 2208957 | 7/2010 |
| EP | 3489612 | 11/2018 |
| FR | 1483260 | 6/1967 |

OTHER PUBLICATIONS

European Patent Office, "Extended European Search Report," dated Feb. 19, 2019 in connection with European Patent Application No. 18203925.5, 9 pages (including translation).

IP Australia, "Examination Report No. 1," dated Sep. 27, 2019 in connection with Australian Patent Application No. 2018256657, 4 pages.

IP Australia, "Examination Report No. 2," dated Mar. 19, 2020 in connection with Australian Patent Application No. 2018256657, 3 pages.

Japanese Patent Office, "Notice of the Reason for Refusal," dated Mar. 24, 2020 in connection with Japanese Patent Application No. 2018-218945, 10 pages (including translation).

IP Australia, "Examination Report No. 3," dated Jun. 25, 2020 in connection with Australian Patent Application No. 2018256657, 5 pages.

Canadian Intellectual Property Office, "Office Action," dated Apr. 29, 2020 in connection with Canadian Patent Application No. 3,022,993, 4 pages.

German Patent Office, "Office Action," dated Jan. 28, 2019 in connection with German Patent Application No. 102017010908.7, 5 pages.

German Patent Office, "Office Action," dated Apr. 12, 2021 in connection with German Patent Application No. 102017010908.7, 4 pages.

United States Patent and Trademark Office, "Non-Final Office Action," dated Sep. 11, 2019 in connection with U.S. Appl. No. 16/198,474, 8 pages.

United States Patent and Trademark Office, "Final Office Action," dated May 26, 2020 in connection with U.S. Appl. No. 16/198,474, 7 pages.

United States Patent and Trademark Office, "Notice of Allowance," dated Nov. 24, 2020 in connection with U.S. Appl. No. 16/198,474, 7 pages.

United States Patent and Trademark Office, "Notice of Allowance," dated Apr. 15, 2021 in connection with U.S. Appl. No. 16/198,474, 6 pages.

United States Patent and Trademark Office, "Corrected Notice of Allowability," dated Jul. 22, 2021 in connection with U.S. Appl. No. 16/198,474, 2 pages.

IP Australia, "Examination Report No. 2," dated Sep. 2, 2021 in connection with Australian Patent Application No. 2020233646, 4 pages.

IP Australia, "Examination Report No. 1," dated May 11, 2021 in connection with Australian Patent Application No. 2020233646, 3 pages.

* cited by examiner

MAGAZINE APPARATUS FOR SELF-LOADING FIREARMS

RELATED APPLICATION

This patent arises from a continuation of U.S. patent application Ser. No. 16/198,474, entitled "Magazine Apparatus for Self-Loading Firearms" and filed on Nov. 21, 2018. U.S. patent application Ser. No. 16/198,474 is hereby incorporated herein in its entirety. Priority to U.S. patent application Ser. No. 16/198,474 is claimed. In addition, benefit is claimed under 35 U.S.C. 119(a)-(d) to Foreign Application Serial No. 10 2017 010 908.7, filed in Germany on Nov. 24, 2017, and which is herein incorporated in its entirety.

FIELD OF THE DISCLOSURE

This disclosure relates to a magazine with a magazine floor plate as well as a self-loading firearm with such a magazine.

BACKGROUND

Magazines for self-loading firearms and self-loading firearms that are equipped with such, e.g. assault rifles, submachine guns, precision rifles, etc., are known in different versions. Within a magazine, the cartridges are stored either in a single row or in a double row, alternatingly in a zig-zag-manner.

A magazine, such as e.g., according to the NATO standard, includes a magazine catch on the left side of the magazine housing. If a shooter has inserted such a magazine completely into a magazine shaft of a self-loading firearm, a holding bracket of a spring-loaded magazine release/holding device automatically reaches into the magazine catch that is arranged in or at the housing of the firearm. The magazine is then safely engaged in its operating position in the self-loading firearm.

To release the magazine, at least one hand lever is usually provided at the magazine release/holding device. If a shooter operates the hand lever, the hand lever pulls and/or pushes the holding bracket out of the magazine catch. In this way the magazine is released and can be removed from the firearm by the shooter, or falls downwards out of the magazine shaft in the normal shooting position of the self-loading firearm. A shooter can now insert a new magazine into the magazine shaft and the magazine will then again lock in this position.

The functional sequence during firing and automatic reloading in a self-loading firearm can be described in a simplified manner as follows:

In the housing of the firearm, a block arrangement that is guided in such a way that the block can be moved in longitudinal direction is provided for the firing of the bullet, for the pulling out of the fired cartridge casing as well as for its reloading. For the firing of the bullet, the block arrangement, in particular the blocking head of the block arrangement, inserts the uppermost cartridge from the magazine in a known manner into a cartridge chamber in the barrel. When the trigger mechanism is pulled, a firing pin hits on the cartridge base and ignites the propelling charge there, so that the projectile is fired out of the cartridge case through the barrel. As the projectile passes through the bore in the gun barrel, the propellant gases that were released during the firing procedure in a gas-operated gun can be branched off into a gas discharge. The branched off propellant gases are used to transfer the block arrangement in the well-known manner into a backward motion. The propellant gases hereby push the block arrangement via the gas discharge and a gas linkage that is coupled thereto at high speed backwards in the direction of the shaft.

An extractor is provided at the blocking head. The extractor grips around a cartridge case at the edge on its cartridge base and pulls the cartridge out of the cartridge chamber during the return movement of the block arrangement. An ejector provision then ejects the cartridge case via a cartridge ejection window in a known manner out of the firearm housing. During the return motion of the block arrangement, the block arrangement slides over the magazine towards the rear in the direction of the shaft. During the subsequent forward motion of the block arrangement, the blocking head in particular again grasps the uppermost cartridge from the magazine and feeds the cartridge into the cartridge chamber and the cycle is repeated. Alternatively, a recoil loading mechanism can be used in a known manner for this cycle.

In order to feed a cartridge, the upper side of the magazine rear wall, as well as the magazine front wall, is arranged with a respective recess along a certain distance at its upper end. The side walls of a magazine are extended towards the top and form so-called magazine lips, which prevent the cartridge from falling out of the magazine. A spring that is arranged within the magazine forces the cartridge feeder upwards within the magazine housing and the cartridge feeder thereby pushes the cartridges upwards towards the magazine lips.

From the prior art, magazines are known that are closed at the lower end of the magazine housing, in which a loading of the magazine with cartridges is carried out from the top, wherein a shooter pushes the cartridges from above against the spring force of the feeder spring against the feeder into the magazine housing. Due to the resistance of the magazine spring, this can damage the magazine lips, especially with frequent use or reloading of the magazine.

In repeating rifles, for example, permanently installed magazines are known, in which a magazine floor plate that can be opened downwards is provided to take out the cartridges. For the Russian rifles and carabiners of the Mosin-Nagant 1891 system, a spring-loaded locking lug is pushed backwards to release the magazine floor plate. In the case of the Heym repetierer SR 20, a hinged magazine lid closes the box magazine that can contain five cartridges. A magazine lid pusher for the releasing of the magazine lid is located in the front portion of the trigger guard. These solutions are structurally complex and require additional means for blocking and opening.

Furthermore, magazine floor plates are also known that are separable from a magazine housing, or which can be completely removed. Disadvantageously, such a magazine floor plate can be lost due to having been separated from the magazine housing when a magazine was removed.

From the DE 10 2006 011 278 B4, a plastic magazine is known which comprises side walls, along which the cartridges move. The front wall in firing direction is provided with a metal coating or with a metal insert on the side, along which the cartridges are guided.

The U.S. Pat. No. 2,488,233 A describes a magazine with a side wall that can be pivoted towards the side in order to load the magazine with cartridges.

The U.S. Pat. No. 7,497,044 B2 describes a magazine with a magazine front wall which can be moved downwards in order to load the magazine with cartridges. The moving of the magazine front wall downwards also guides a feeder within the magazine downwards and thus compresses the magazine spring.

Finally, the U.S. Pat. No. 5,081,778 A describes a magazine comprising a mechanism for reducing the spring tension during the loading procedure of the magazine with cartridges. In one embodiment, an insert that can be pivoted downwards is provided within the magazine floor plate. Its size is determined in such a way that in the open position, the magazine spring along with the magazine insert can be partially pushed downwards out of the magazine. The pivotable insert then holds the magazine spring and the magazine insert in this position.

In an alternative example, an insert that can be moved sideways is provided within the magazine floor, in such a way that after the insert is moved, the magazine spring along with the magazine insert penetrate an opening that is formed in the magazine floor downwards. The insert that was pushed out of the magazine, protrudes out in lateral direction and can hinder the shooter or be damaged.

DETAILED DESCRIPTION

Figure 1:
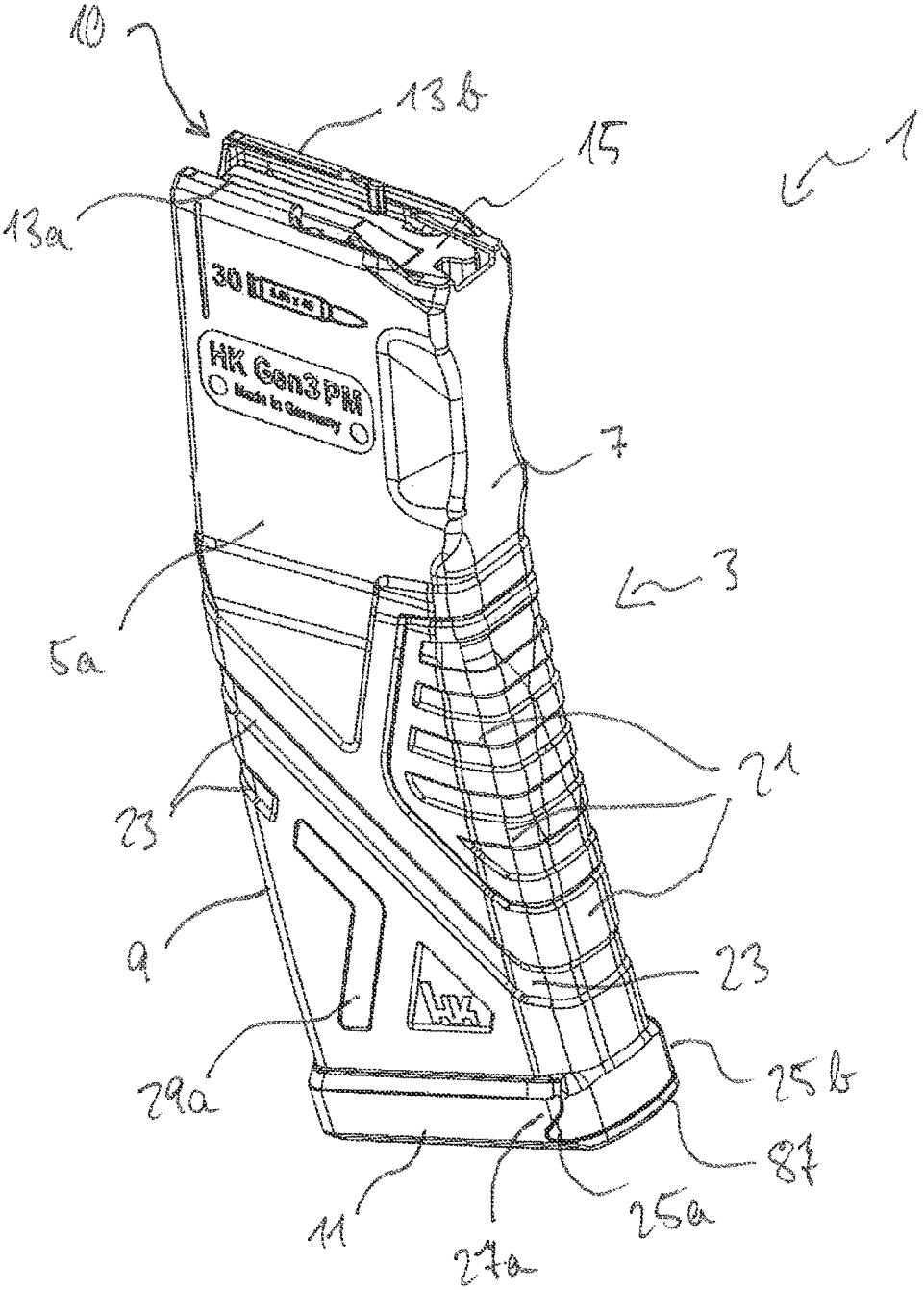
FIG. 1 is a perspective view from an angle from the front right of a magazine with a closed floor plate.

In this document, the location references such as above, below, front, behind, etc. refer to a magazine, which basically feeds cartridges in a self-loading firearm in vertical direction from the bottom, in which the bore axis runs horizontally and the firing occurs towards the front, away from the shooter. If a magazine can be inserted into a self-loading firearm in a different way, such as possibly from top to bottom (Bren machine gun) or in horizontal direction (Sten submachine gun), then the location references have to be interpreted accordingly.

In this context, it is the objective of the disclosure to provide an alternative, structurally simple and reliable magazine for self-loading firearms. This objective is achieved by means of the subject-matter set forth in the claims.

The genre-forming magazine thus additionally features the following characteristics: The magazine floor plate is provided in such a way that it is slidable between the magazine closing and magazine opening positions and it is pivoted in its magazine opening position at the magazine housing. The magazine floor plate according to some examples is characterized by the use in such a magazine. A firearm according to some examples is characterized in that it is equipped with such a magazine.

The magazine according to the disclosure is manufactured out of a suitable plastic material. The production, e.g. by means of an injection molding procedure, is cost-efficient and such a magazine is characterized by a high dependability. For example, a plastic magazine does not get dented in comparison to a magazine made of sheet metal, but a plastic magazine can break, so that a damage is immediately recognizable to the shooter.

A plastic magazine with appropriate dimensioning is also more sturdy, lighter and can be freely formed in comparison to sheet metal magazines. A magazine e.g. for 7.62×51 or 5.56×45 mm (NATO cartridge) features a curvature that corresponds to the front edge of the stack of cartridges that is stored in it, based on a slight conicity of the cartridges.

The magazine floor plate can be designed to be entirely or partially movable and in addition pivotable at the magazine housing. It is hereby possible that either the entire magazine floor plate or only an insert, which is arranged on it, is designed in such a way that it can be moved or pivoted. The additional pivotability allows the magazine floor plate to be swung in or out with regards to the magazine housing, so that in the magazine floor plate does not protrude out of the magazine opening position and thereby hinder a shooter or is subject to possible damage.

The magazine floor plate can, for example, be designed in such a way that it is movable at an angle towards the longitudinal axis of the magazine housing. In a structurally simple embodiment the magazine floor plate is movable in transverse direction towards the longitudinal direction of the magazine housing and, as soon as it has reached its magazine opening position, the magazine floor plate is additionally pivotable. This measure prevents an unintentional pivoting.

It is also not intended that the magazine floor plate can be completely disassembled or removed from the magazine housing, since the magazine floor plate is hinged to the magazine housing. It is thus ensured that the magazine floor plate does not get lost when the magazine is demounted, or that it is designed in an undetachable way.

In the magazine opening position, the feeder, the magazine insert and the magazine spring can be pulled out completely or at least partially from the magazine shaft. After a pivoting of the magazine floor plate, the magazine floor plate unlocks the lower side of the magazine housing, so that the spring tension of the magazine spring pushes the magazine insert downwards, out of the magazine shaft. The magazine spring tension is thereby completely relaxed.

The magazine floor plate can be manufactured with simple constructional means, for example, in an injection molding procedure.

Preferably, at least one safety element secures the magazine floor plate against an unintentional demounting from the magazine housing.

The safety element can be provided in or at the magazine floor plate and/or in or at the magazine housing. The safety element can be designed in one single piece at the magazine housing, for example, when using the injection molding procedure or also as an additional element in or at the magazine floor plate or be inserted in or at the magazine housing or be coupled to the magazine floor plate. As an example, a suitable insert element such as a pin, stud, bolt, hinge, etc. can be provided or inserted in order to couple to a corresponding complementary formation (recess) in or at the magazine floor plate or in or at the magazine housing, which secures the magazine floor plate to the magazine housing.

In the magazine according to the disclosure, at least two safety elements, in particular in the form of hinge pins, are preferably formed on both sides in or at the magazine floor plate or in or at the magazine housing and serve as a pivot axis of the magazine floor plate in the magazine opening position.

The at least two safety elements, in particular the hinge pins, can be inserted into the magazine floor plate or into the magazine housing or be placed onto it.

In a structurally simple embodiment, the safety elements are integrally formed at the magazine floor or at the magazine housing, for example, by means of the injection molding procedure. A double-sided design or arrangement also ensures a smooth moving or pivoting motion of the magazine floor plate. The two hinge pins engage with a complementary counter formation, possibly a recess, notch, etc. in or at the magazine floor plate or in or at the magazine housing and ensure that the magazine floor plate cannot get lost when it is demounted.

The at least two safety elements, in particular the hinge pins, are preferably led within a respective guideway that is provided or arranged in or at the magazine housing or in or at the magazine floor plate so that they can be moved and/or they can be pivoted and hinged.

In a simple embodiment, the guideway can, for example, be provided as a guiding groove in the or at the magazine housing or magazine floor plate, in which the hinge pins are led in such a way that they can be moved and/or pivoted. The guiding grooves are thereby formed on both sides of the magazine housing or at the magazine floor plate, so that the at least two hinge pins are securely and firmly guided.

In addition to the hinge pins, even more guiding elements may be provided, in particular guiding rails on both sides in or at the magazine floor plate or in or at the magazine housing. Such guiding rails can extend across the entire or partial width of the magazine housing or the inner side of the magazine floor plate. They are to be inserted into complementary guiding grooves that are formed for this purpose in or at the magazine floor plate or in or at the magazine housing.

This measure of additional guiding elements increases the stability of the guiding of the magazine floor plate in relation to the magazine housing, in particular when the magazine floor plate is displaced or moved into its magazine opening and magazine closed position. This measure also ensures that the magazine spring does not accidentally push the magazine insert and the magazine spring itself downwards out of the magazine housing or out of the magazine shaft, before the magazine floor plate has reached its magazine opening position.

The hinge pins can be provided at correspondingly suitable positions at the magazine floor plate or magazine housing. They are preferably intended to be in the front inside of the magazine floor or at the rear outer side of the magazine housing. For hinge pins that are arranged at the front inside of the magazine floor, a guiding of the magazine floor plate across the entire width of the magazine housing can be ensured. This effect can be additionally increased by means of the guiding rails.

In particular in the case of a one-piece design of the hinge pins at the magazine floor and/or magazine housing, the magazine floor plate can be removed by means of, for example, a deliberate and forceful deforming for its replacement from the magazine and for the fitting on of the new magazine floor plate. However, this measure is only necessary in rare cases and in particular in the case of a damage of the magazine floor plate. In normal operation, the at least two safety elements, in particular the hinge pins are designed in such a way, that they tightly connect the magazine floor plate to the magazine housing and to hold it securely in that place.

It is preferred that the at least two guideways feature at least one limit stop element, which limits a respective motion path of the at least two hinge pins. In a structurally simple embodiment, the guiding recesses are closed at their end in or at the magazine floor or in or at the magazine housing, so that the two respective hinge pins will be brought to rest against the limit stop there. This measure additionally prevents an accidental removal or demounting of the magazine floor plate with structurally simple means. It is also possible to repeatedly stipulate the exact magazine opening position in this way.

The magazine floor features a suitable geometric configuration. The magazine floor plate preferably includes at least one actuating section, which is particularly designed in a ramp-like manner, which wedges or braces or also releases the magazine floor plate when the magazine floor plate is displaced from its magazine opening position into its magazine closing position and vice versa against a counter section, which is designed in a complementary way at the lower side of the magazine.

The at least one actuating section that is designed in a particularly wedge- or ramp-like manner and the corresponding counter sections proceed against each other when the magazine floor plate is brought into the magazine closed position, which braces both sections against each other. The magazine floor plate is hereby lifted up in relation to the magazine housing and is braced.

The actuating section and the counter section may extend across the entire or partial width of the magazine housing or magazine floor. It is also possible that two or more actuating sections and counter sections are provided that are particularly arranged or designed in a parallel way towards each other.

Advantageously, the actuating section and the counter section also serve to reinforce the magazine floor and provide additional support surfaces. This measure improves the durability and stability of such a magazine, especially in a drop test, in which the magazine is being dropped from a height of about 1.30 meters.

Preferably, at least one locking element is provided in or at the magazine floor, which locks or unlocks the magazine floor plate when it is moved from its magazine opening position into its magazine closed position and vice versa against at least one complementary counter latch that is provided on the lower side of the magazine housing.

The at least one locking element and the at least one complementary counter-latching element may feature different suitable geometries. It is possible to, for example, provide protruding geometries, such as lugs, projections, etc. in the side walls of the magazine floor, which engage in the magazine closed position with one or more complementary counter latches, such as a recess, at the magazine housing. Alternatively and/or additionally, it is also possible to provide one or more of such locking elements at the magazine housing which engage with corresponding counter-recesses in or at the magazine cover, in particular on its side walls.

Furthermore, wedge-shaped locking sections may also be especially provided at the side walls of the magazine floor, which engage with complementary counter-sections in or at the magazine housing. Advantageously, these serve for the guiding and, in particular, for a secure locking of the magazine floor plate at the magazine housing. Such locking elements can be formed with structurally simple measures, such as, for example, in one-single piece during the injection molding procedure. In this way a secure position at the rear and a locking of the magazine floor plate at the magazine housing is ensured. For example, a secure position at the rear and a locking of the magazine floor plate at the magazine housing is ensured in this manner.

The magazine floor plate and/or the magazine housing can be provided as a respectively sealed unit. However, it is preferred that the magazine floor plate and/or the magazine housing feature at least one fluid passage opening.

The fluid passage opening can be provided in various suitable geometries in the magazine floor plate or magazine housing, for example, in a slit-shape, as a bore hole, an opening, as holes, etc. The at least one fluid passage opening serves to discharge any fluid that has entered into the magazine, such as water and, depending on its size, also any dirt and/or deposits, which is contained in the water or fluid.

Preferably, at least one recess is provided on the lower side of the magazine housing, which serves to form a fluid passage opening between magazine housing and magazine floor.

The cut-out section may extend across the entire or partial width or cross-section of the magazine underside. It can be particularly provided at the front part of the lower side of the magazine housing, so that a slot or gap is formed in the magazine closed position between the magazine floor plate and the magazine housing and fluid can be discharged from the magazine towards the outside. The cut-out section can be formed with simple constructional means, for example, during the manufacturing of the magazine.

Within or at the magazine shaft, in particular on the inner side of its rear wall, at least one guiding section for the guiding of at least one complementary counter-guiding element is preferably provided in or at the magazine insert and/or in or at the feeder.

The guiding section may be provided in a structurally simple design, for example, as a groove or rib or guiding rail which extends throughout the entire magazine housing in longitudinal direction, or only through parts of it. A corresponding counter-guiding element which is provided in or at the magazine insert or the feeder may, for example, be provided as a complementary rib, projection that is made of a suitable geometry, which engages with the groove or which is provided as groove or recess in the magazine insert or in the feeder. The guiding section serves on the one hand as a guide, but also as a support for the feeder and/or for the magazine floor plate in the magazine housing.

Preferably, at least one guiding element for the guiding of the magazine insert and/or for the feeder is provided within the magazine shaft, in particular on the inner side of the side walls and/or of the front wall.

The at least one guiding element can be provided, for example, in form of a rib, a bar or a rail, for example as a guiding rib that is provided on both sides at the side walls, on which the magazine insert and/or the feeder are supported and/or on which these are guided respectively. It is also possible that a guiding rib may be provided on the inner side of the front wall of the magazine shaft, which extends over the entire or partial length of the magazine housing and which is used to guide the magazine insert and/or the feeder. Likewise, it is possible that the magazine insert rests on this guiding rib in the front, but in the particular case of the feeder, this is not mandatory.

In a preferred embodiment, the feeder is designed in such a way that it is supported only on the guiding elements or ribs in the side walls and/or in the guiding section in the magazine rear wall.

Additionally or alternatively, further guiding elements, such as, for example, ribs, can be provided particularly in the upper portion of the magazine housing, for example, centrally in the region of the front end of the magazine lips for an additional guiding.

The applicant reserves the right to request independent protection for this embodiment of the magazine housing and/or of the feeder. It is preferred that the magazine housing is provided with at least one cut-out and/or insert for viewing in order to check the loading state of the magazine.

The at least one cut-out for viewing can be provided on the rear side and/or on one or both side walls of the magazine housing. The cut-out for viewing can be provided, for example, as a recess into which a particularly translucent or transparent insert element is inserted and appropriately fastened, for example, glued or latched.

In addition, the magazine spring can e.g. be marked with a color on one coil, so that a shooter can detect the number of cartridges that are still contained in the magazine, depending on the position of the colored marking within the cut-out or insert for viewing, since the inserted cartridges in the magazine housing compress the magazine spring. Additionally, suitable markings, such as position lines, numberings, etc., may also be provided on the magazine housing in addition to the cut-out for the viewing.

The feeder and the magazine insert are preferably coupled to each other via an elastic element, in particular a magazine spring, and are held in a pre-loaded manner in the magazine closing position.

This measure ensures a secure guiding of the feeder and of the magazine insert within the magazine housing. The respective ends of the magazine spring are thus coupled to the feeder or to the magazine insert, respectively. The feeder can therefore feature a receiving opening, in particular a loop, on its lower side, into which the end of the magazine spring is inserted. The receiving loop can e.g. be formed in the center position at the lower side of the feeder in a section for reinforcement.

It is also possible, for example, that a loop is provided in a reinforcement section on the upper side of the magazine insert that receives the end of the magazine spring. In addition to this, a limit stop can be provided at the upper side of the magazine insert or inside the feeder, which limits the inserting of the end of the spring.

Preferably, the magazine insert includes a locking tab at its lower side for a coupling with a recess that is formed in a complementary way in the magazine floor plate, which holds the magazine floor plate in its magazine closed position. Alternatively, the locking tab can also be provided at the magazine floor plate and can be engaged via a recess in the magazine insert.

In the magazine closed position, the magazine spring forces the feeder up and the magazine insert downwards. When the magazine floor plate is moved from its magazine opening position into its magazine closed position, the magazine insert has to be pushed against the force of the magazine spring into the magazine shaft at first, before the magazine floor plate can be moved after it has been pivoted. After the locking tab has been passed, it engages with the recess in the magazine floor and locks or engages the magazine floor plate securely in the magazine closed position. This measure also prevents an accidental opening of the magazine floor plate.

Preferably, the lower side of the magazine insert in the region of the locking tab features an at least partially deepened section.

The deepening may extend across the entire or partial surface of the lower side of the magazine insert. Lateral ribs at the magazine insert can particularly serve for a limiting of this deepening. The deepening can be formed particularly during the manufacturing of the magazine insert such as by means of the injection molding procedure.

Especially in combination with lateral ribs at the magazine insert, a distance between the deepening surface at the lower side of the magazine insert and the inner side of the magazine floor plate can be ensured, through which e.g. fluid, especially in combination with the mentioned fluid passage openings, can be discharged in a simple manner.

It is preferred that at least one recess is provided at the feeder, in particular in the area of its outer sides in front. It is particularly preferred that it is formed or provided on both sides.

With structurally simple means, this measure allows to improve the functionality and in particular the longitudinal guiding of the feeder within the magazine shaft, in particular under adverse conditions. For example, dirt, sand, dust, etc. which penetrates or has penetrated into the magazine housing etc. does not have to be removed, since the dirt can settle in the lateral recesses. Additionally, the weight of the feeder and thus of the entire magazine can thereby be advantageously further reduced. Furthermore, the resulting hollow space can be cleaned in a simple manner.

The feeder preferably comprises at least one spacer on its upper side. The spacer may correspond in its geometrical configurations approximately with the dimensions of a cartridge and extends in whole or in part along the longitudinal direction of the feeder. With a double-row arrangement of the cartridges within the magazine in line with a zig-zag guiding, it is thus also possible to ensure the feeding of the last cartridge. In particular, the last cartridge that is remaining in the magazine or the first cartridge that is inserted into the empty magazine can be supported on the spacer. The spacer can be produced during the manufacturing of the feeder, for example, by means of the injection molding procedure in a structurally simple manner.

The structure and the functionality of magazine 1 and of magazine floor plate 11 in accordance with the disclosure will be discussed on the basis of the FIGS. 1-5 at first. The reference signs are not inserted continuously into all the figures, in order not to affect the clarity. However, the same reference signs apply continuously to all figures.

Figure 2:
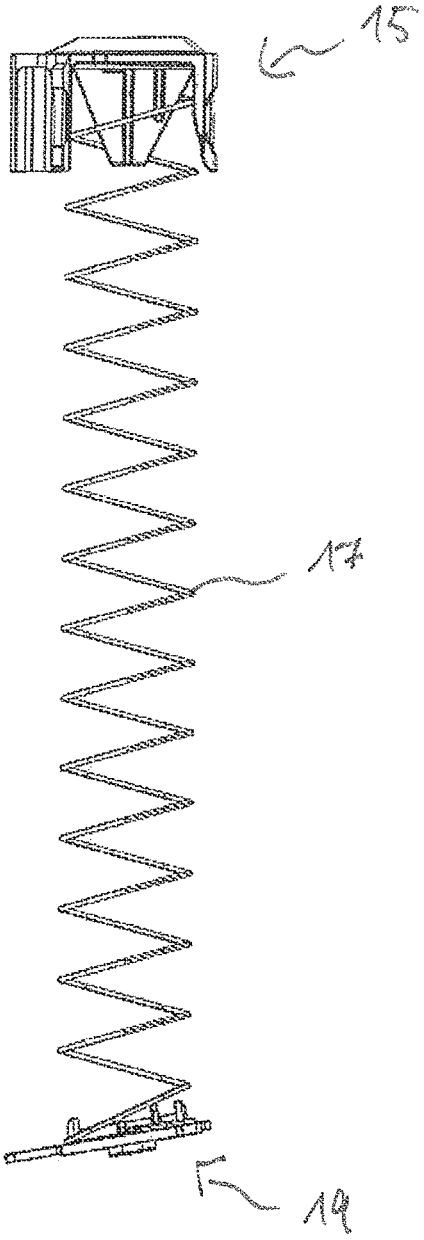
FIG. 2 is a side view from the left side of a feeder which is connected via a spring to a magazine insert.

FIG. 1 shows an overall perspective view of a magazine 1 according to the disclosure in a perspective depiction from an angle from the front right. In the present example, magazine 1 is provided for an assault rifle, it has a holding capacity of 30 cartridges in the caliber 5.56×45 and essentially comprises the following elements: a magazine housing 3, a slidable and pivotable magazine floor plate 11, a feeder 15 that can be moved in longitudinal direction within magazine housing 3, which is coupled via a magazine spring 17 to a magazine insert 19, which can likewise be moved in longitudinal direction within magazine housing 3 (see. FIG. 2).

Magazine spring 17 is attached at its lower end to magazine insert 19 and at its upper end to feeder 15 and pushes this one upwards within a magazine shaft 10 in magazine housing 3. Feeder 15 in turn pushes the cartridges (not shown) upwards, so that the cycle, which was described above, can be carried out during shooting and reloading. The present embodiment shows a double-row magazine.

The cartridges are thus arranged in two adjacent rows, wherein the individual cartridges of the two rows are placed in a zig-zag manner in relation to each other.

Magazine housing 3 is designed essentially in a rectangular manner, possibly as a box or tubular magazine, and comprises two side walls 5*a* and 5*b*, which are respectively connected in a one-piece manner by means of a front wall 7 and a rear wall 9. Magazine floor plate 11 is hinged in a slidable and pivotable manner at the bottom of magazine housing 3. On the upper side of magazine housing 3, the magazine lips 13*a* and *b* are provided on both sides, approximately in the center of magazine housing 3, extending towards the rear, which hold back the cartridges in magazine housing 3. Within magazine housing 3, feeder 15, which is depicted in FIG. 2, is guided in the magazine housing so that it can move in longitudinal direction. Feeder 15 is coupled via magazine spring 17 with magazine insert 19. Magazine insert 19 in turn is intended to couple with magazine floor plate 11, in order to lock it at the magazine housing in its magazine closed position (compare among others FIGS. 1 and 3 to 6).

FIG. 1 depicts an empty magazine. To demount the magazine, magazine floor plate 11 is first of all moved backwards into its magazine opening position at magazine housing 3 (compare FIGS. 12 to 14). In the magazine opening position, magazine floor plate 11 can be pivoted so that it rests against the outer surface of magazine housing 3 (compare FIG. 12-14). After a pivoting of magazine floor plate 11, it unlocks the lower side of magazine housing 3, so that the spring tension of magazine spring 17 pushes magazine insert 19 downwards, out of magazine shaft 10. The tension of magazine spring 17 is thereby completely relaxed. Along with feeder 15, it is also possible to take out magazine insert 19 and magazine spring 17 at least partially or completely downwards out of magazine 1.

For the mounting of the magazine, feeder 15 and magazine insert 19 together with magazine spring 17 can be moved upwards into magazine shaft 10, wherein magazine spring 17 is being compressed when feeder 15 comes to rest against the magazine lips 13*a, b*. Magazine floor plate 11 can then first of all be pivoted via magazine insert 19 and then be pushed into its magazine closed position and securely latch with the magazine insert (see, inter alia, FIGS. 1, 3 to 5, 17, 18, 23 and 24).

After magazine 1 has been inserted into a self-loading firearm (not shown), such as an assault rifle, it is possible to feed cartridges from magazine 1 into the cartridge chamber (not shown) so that they can be fired, and to remove the empty cartridge case after firing in dependence of the firing mode single fire, continuous fire, etc. by means of the block movement as it was described above. Depending on the firing mode, one or more shots are fired or the magazine is completely emptied. Feeder 15 hereby pushes the cartridges in the known manner upwards towards the magazine lips 13*a, b*.

After a last cartridge has been fired, the magazine can be removed downwards or drops down from the self-loading firearm by means of a known magazine release holding device and a new magazine can be inserted.

Magazine 1, as it is shown in FIG. 1 features several elevations in the form of bars 21 and intermediate recesses or grooves 23 on the surface of magazine housing 3. These can be configured in any suitable geometry and serve on the one hand for the optical design of magazine housing 3 as well as for a better feel and grip of magazine 1, in particular when using gloves and/or under difficult conditions, such as dirt, ice, snow, etc.

Magazine housing 3 features on its upper front side 7, approximately within the upper third, deepenings that are formed on both sides and which extend in longitudinal direction of magazine housing 3. These serve for a good grip of magazine 1. Further, a shooter can easily feel the front side of magazine 1 in order to insert it into the magazine slot (not shown) of a self-loading firearm even in the dark.

On the outer underside of the front wall 7, magazine housing 3 widens and includes receptacles 25*a, b* which slopingly extend obliquely downwards in a wedge-shaped manner on both sides towards magazine floor plate 11. These serve as a limit-stop and counter-latch for the magazine floor plate 11 to accommodate complementary counter-guiding and limit-stop surfaces 27*a, b* as well as a reinforcement of the magazine underside.

Figure 3:
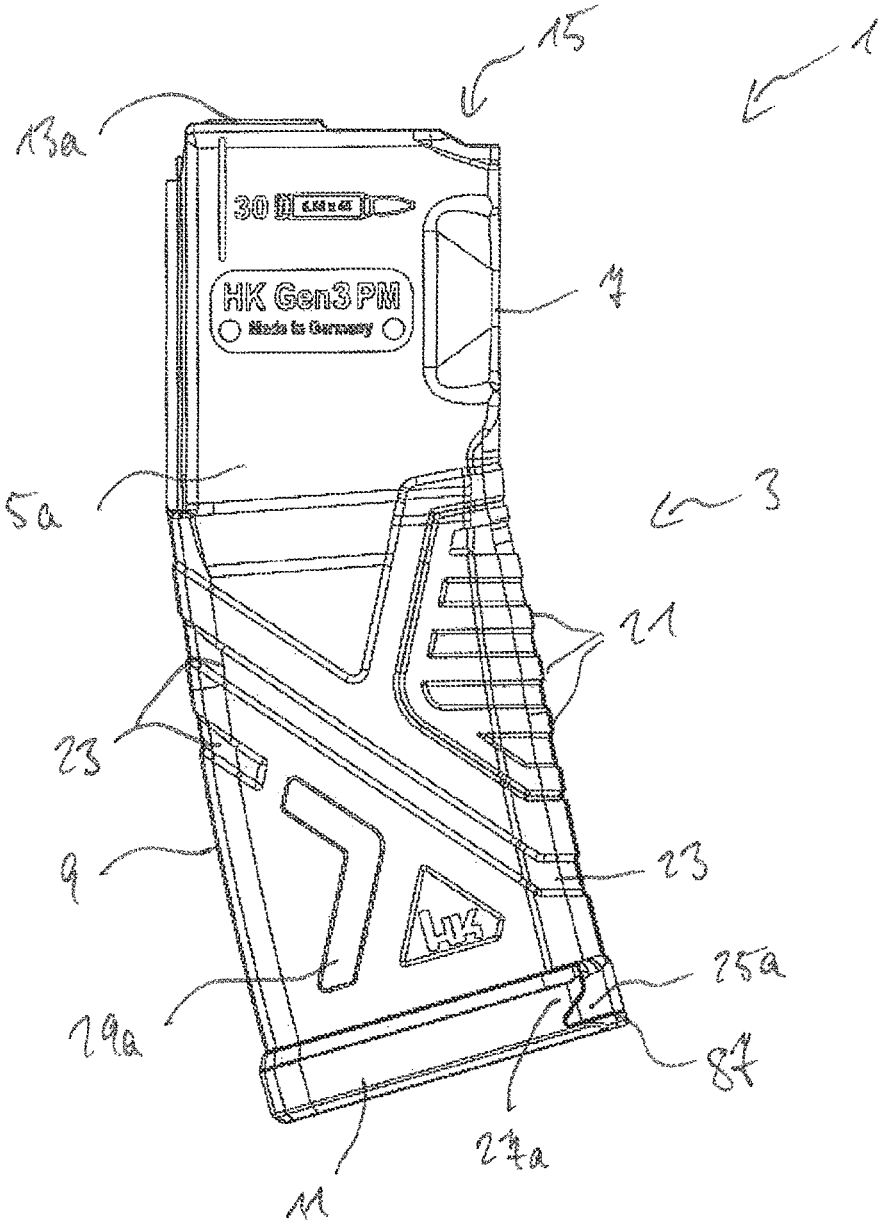
FIG. 3 is a side view from the right side of the magazine of FIG. 1.
Figure 4:
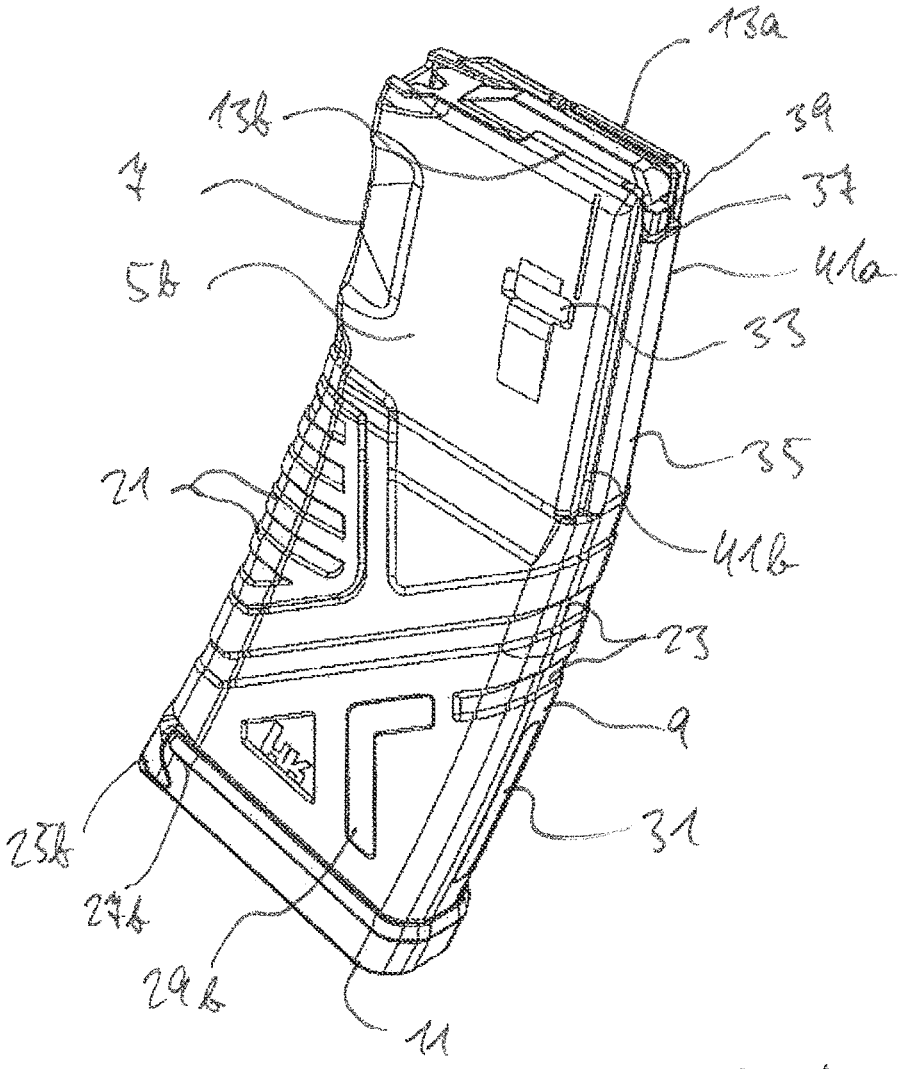
FIG. 4 is a perspective view from the rear left of the magazine of FIG. 1.
Figure 5:
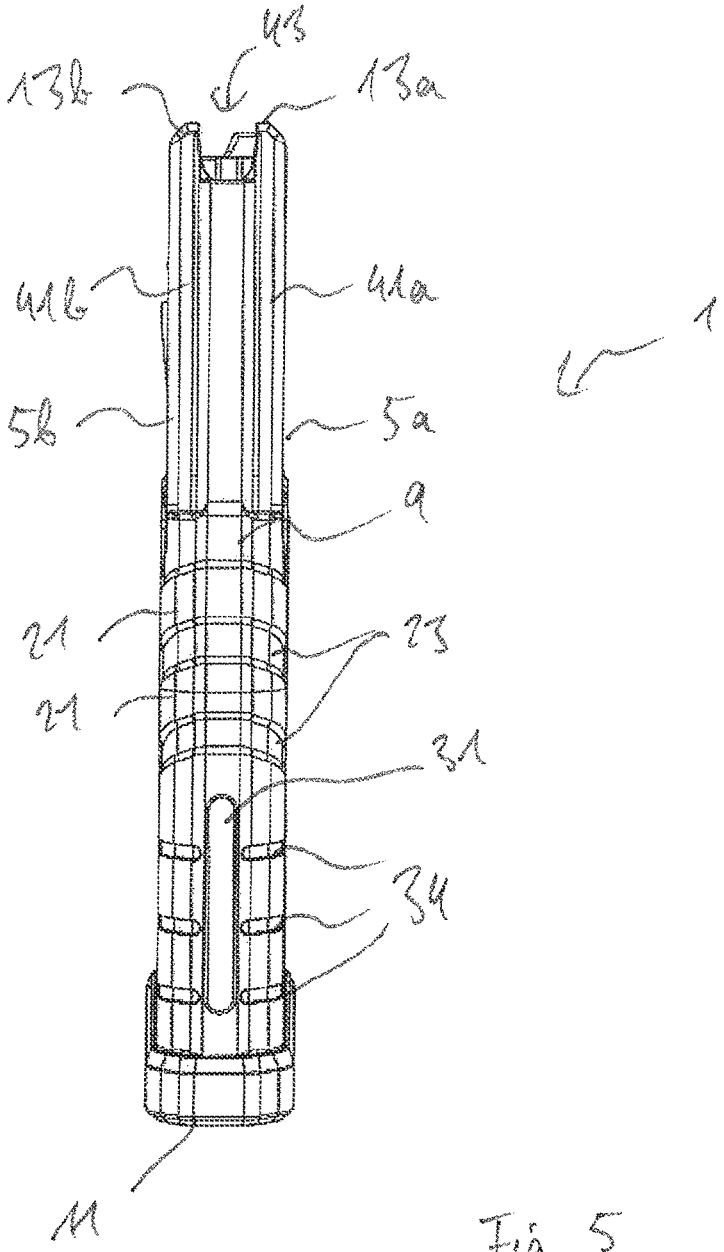
FIG. 5 is a perspective view from the rear side of the magazine of FIG. 1.

Approximately arrow-shaped load level indicators 29*a* and *b* are respectively provided on both side walls 5*a* and *b* of the magazine as well as a rear load level indicator 31 on the rear side 9 (see also FIG. 3-5). These can be inserted into magazine 1 e.g. as a viewing window, such as a transparent plastic insert, for example by means of glue or injection molding. A colored marking on one coil of magazine spring 17 may e.g. be sprayed on and is recognizable from the outside through the load level indicators 29*a, b* and/or 31. Depending on the degree of compression of magazine spring 17, the load level of magazine 1 can be detected indirectly via the marked coil. For this purpose, e.g. parallel markings, such as bars 34 (see FIG. 5) in combination with number indicators (see FIG. 7 or 12-17) can reveal the load level of the magazine to a shooter, approximately 5, 15 or 25 available cartridges.

FIG. 3 shows a side view of magazine 1 from FIG. 1 from the right side. FIG. 4 shows a perspective depiction of magazine 1 from FIG. 1 in a view from an angle from the rear left; Approximately in the upper third of magazine housing 3, a magazine catch 33 is formed on the left side, via which magazine 1 locks into the magazine shaft of a self-loading firearm in a known manner.

On the rear wall 9 of magazine housing 3, a protruding rib 35 is provided, which extends approximately along the upper third, which is designed as a guiding groove 37 (e.g., a recess, a guideway recess) in its inner side in the rear wall 9 within magazine shaft 10. Guiding groove 37 extends over the entire length of the inner side of the magazine housing along rear wall 9 and is provided for the guiding and/or support of a complementary counter formation 39 (e.g., a guiding rib) at feeder 15 (cf. 25 to 28) as well as a complementary counter formation or guiding extension 105 on magazine insert 19 (cf. 21 to 24). On both sides of rib 35, rear wall 9 of magazine housing 3 comprises grooves on both sides in upwards direction towards the magazine lips 13 *a, b*. The recesses 41*a* and *b* serve for the guiding of magazine 1 within the magazine shaft of the assault rifle.

FIG. 5 shows a detailed illustration of the rear load level indicator 31 along with the bar markings 34. On magazine rear wall 9, between the two magazine lips 13*a* and 13*b*, an approximately semicircular recess 43 is provided. It is dimensioned in such a way that during the locking movement, a forward moving locking head (not shown) grasps with its underside a cartridge base of a cartridge that is stored in magazine 1, leads it out of magazine housing 3 and insert it into the cartridge chamber (not shown).

Figure 6:
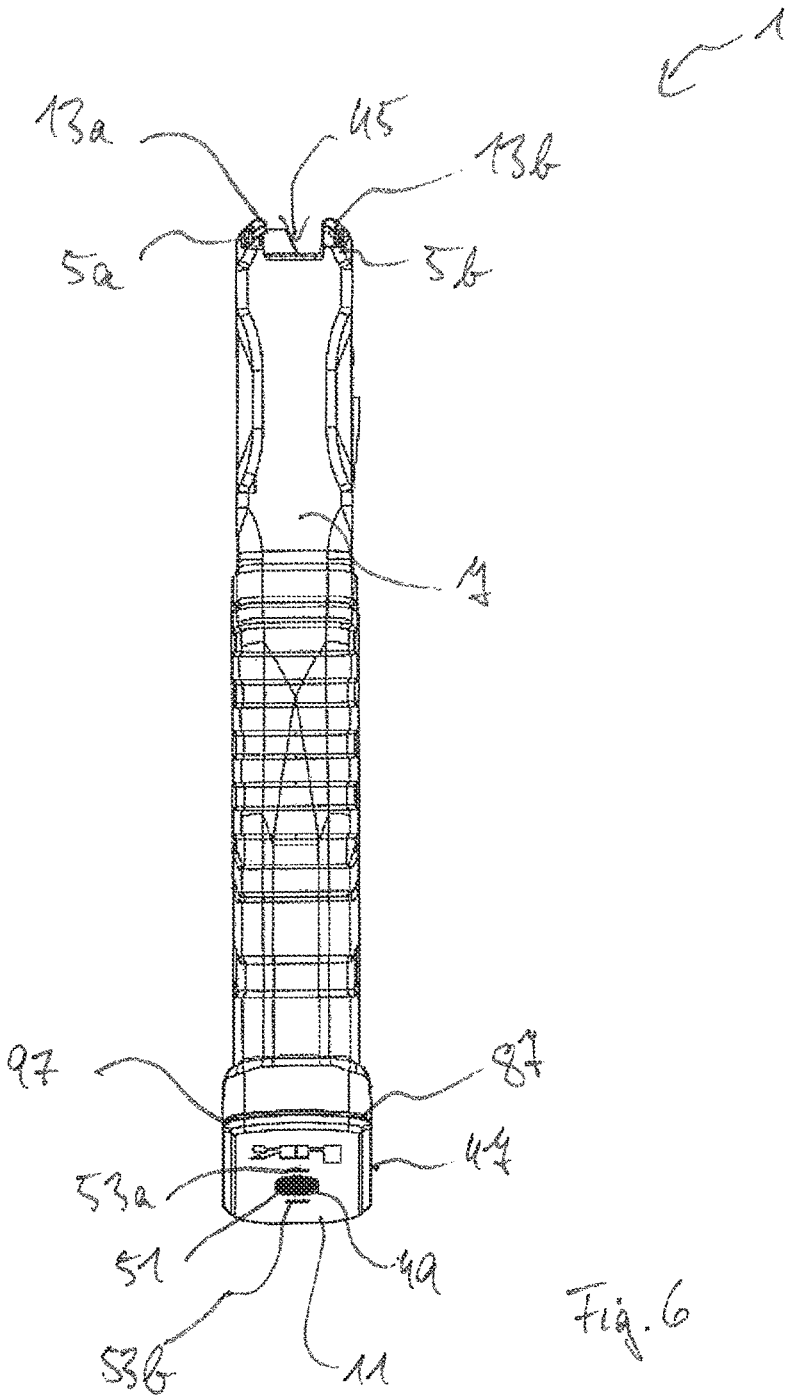
FIG. 6 is a perspective view from the lower front of the magazine of FIG. 1.

As it can be seen from FIG. 6, an approximately rectangular-shaped recess 45 is provided at the upper front wall 7 of magazine housing 3 as an extension of the magazine lips 13*a* and *b*, which approximately extends across the width of front wall 7 between the two side walls 5*a* and *b*. At the lower side of magazine 1, magazine floor plate 11 is shown at an angle from the lower front. The circulating lower edge 47 of magazine floor plate 11 is beveled. Magazine floor plate 11 comprises an oval opening 49 (e.g., a recess, a cut-out) approximately in the center, which engages with a complementary locking tab 51 at magazine insert 19 in the shown magazine closed position in the locked state of magazine floor plate 11 (see FIGS. 10 and 11 as well as 13, 17 and 18 as well as 20). In longitudinal direction of the magazine floor plate, two fluid passage openings 53*a* and *b* are provided, with the purpose to discharge any water or other fluid that may have entered into magazine 1 downwards (cf. FIGS. 10, 11, 13, 17, 18 and 20).

Figure 7:
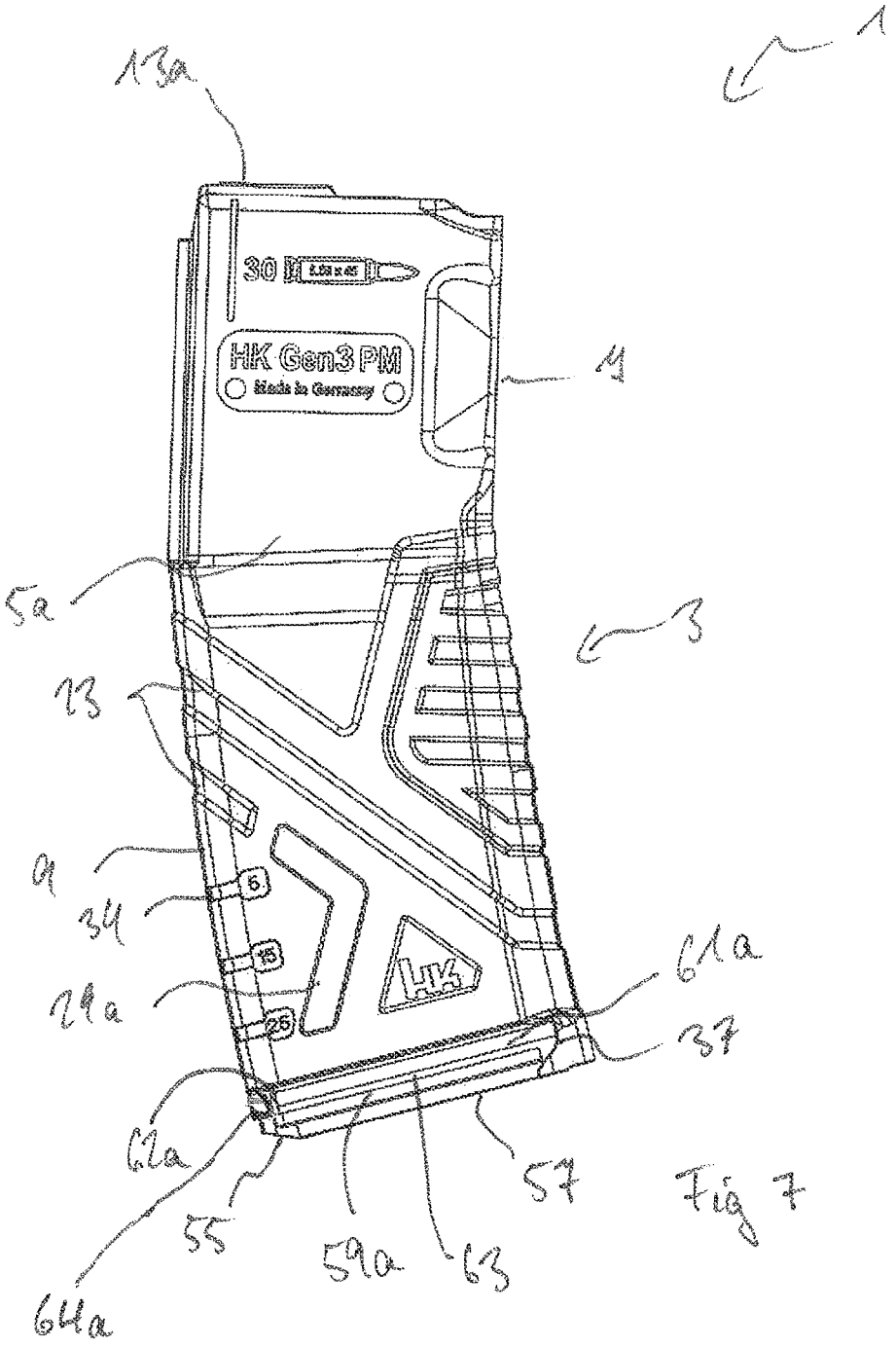
FIG. 7 is a side view of the magazine of FIG. 3 without the magazine floor plate.

FIG. 7 shows an embodiment of magazine 1 according to the disclosure without magazine floor plate 11 and with a numbering of the rear bars 34 or load level indicator 29*a*. Magazine housing 3 includes at its lower side 57 on its rear end a wedge-shaped section 55, which extends approximately across the lower part of the rear wall 9, (see also FIGS. 8, 12 and 14 as well as 15 and 16). The wedge-shaped section 55 enables a folding or pivoting of magazine floor plate 11 upwards in its magazine opening position (see also FIG. 12-17).

Two guiding groove sections 59*a, b* and 61*a, b* that are arranged and that run approximately parallel, extend across almost the entire width of the side walls 5*a, b* at the lower end portion of magazine housing 3. Both are formed in a groove-shaped manner and are separated from each other by means of an intermediate bar 63. The upper guiding grooves 61*a, b* extend in the direction towards the guideway recess 37 slightly longer or further towards front wall 7 than the guiding grooves 59*a* and *b*. The guiding grooves 61 *a* and *b* are used to accommodate complementary guiding pins 65*a, b* that are formed on both sides in the magazine floor plate 11 (see FIG. 10 as well as 12-14 and 19, 20). The guiding pins 65*a* and *b* are provided in an approximately complementary manner with regard to the dimensions of the guiding grooves 61*a* and *b*, so that magazine floor plate 11 can be guided there in longitudinal direction.

The guiding grooves 59*a* and *b* are provided to accommodate guiding rails 67*a, b* that are arranged on both sides inside the inner side wall 91 of magazine floor plate 11 (compare FIGS. 10 and 18, 19) with approximately complementary dimensions. In the magazine opening position, when the magazine floor plate 11 is demounted, the guiding rails 67*a* and *b* are not engaged with the guiding grooves 59*a, b*. When the magazine floor plate 11 is moved into its closed position, the guiding rails 67*a* and *b* engage with the guiding grooves 59*a* and *b*, by means of which a pivoting or folding away of the magazine floor plate 11 is prevented and the guiding of the magazine floor plate 11 is stabilized.

Figure 8:
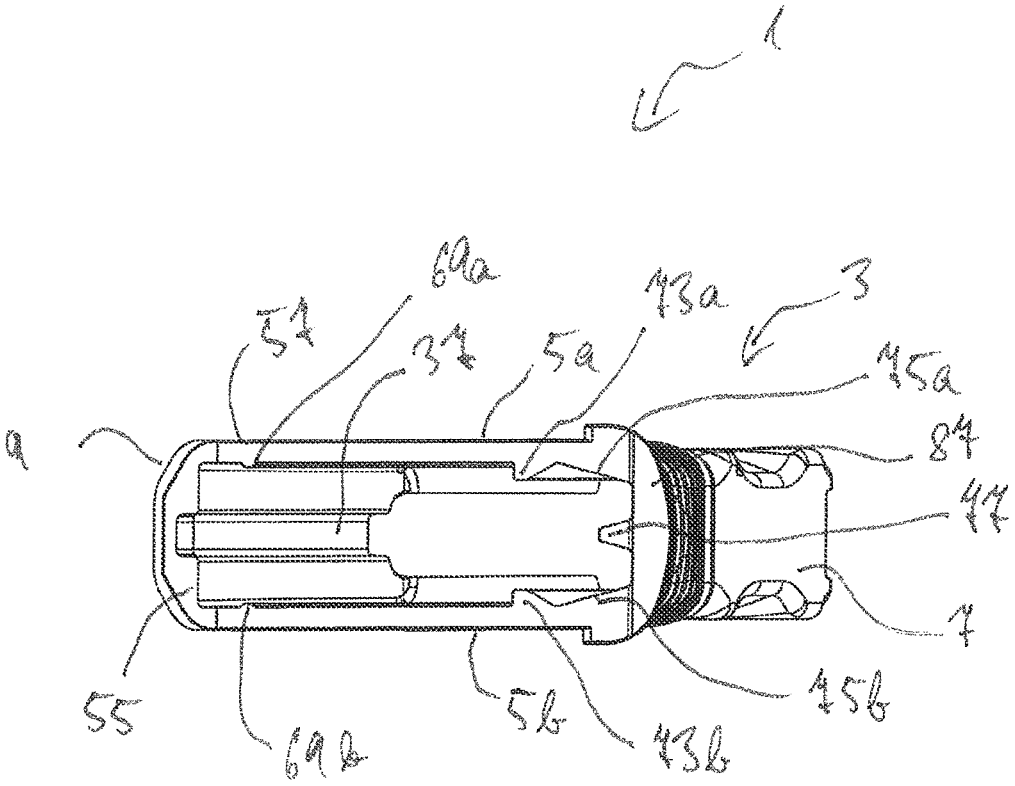
FIG. 8 is a perspective view from below of the magazine housing of FIG. 7.
Figure 9:
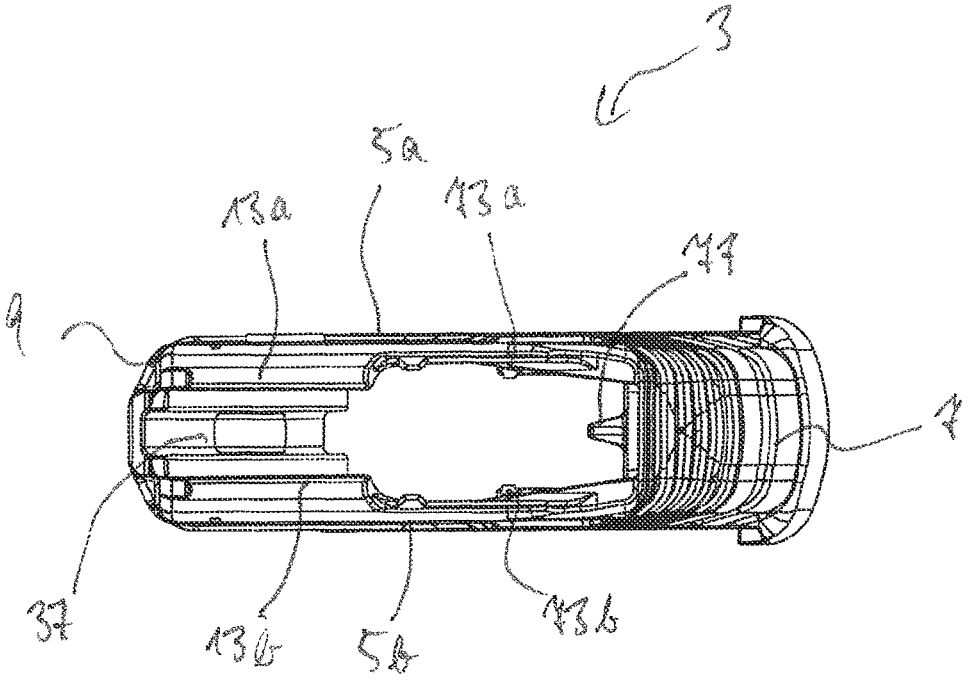
FIG. 9 is a perspective view from above of the magazine housing of FIG. 7.

FIG. 8 shows the lower side 57 of magazine 1 from below and FIG. 9 shows an oblique top view onto magazine 1. The guiding groove 37 extends over the entire length of the housing rear wall 9. Within magazine shaft 10, two guiding ribs 69*a* and *b* extend on the inner sides of the two side walls 5*a* and *b* of magazine housing 3 on both sides over the entire length of magazine housing 3 parallel to rear wall 9 with a slight distance. Their function is a guiding in the rear of magazine insert 19 within magazine housing 3 (compare also FIG. 17 as well as FIG. 21-24). To accomplish this, magazine insert 19 features complementary half-round guiding recesses 71*a* and *b* on both sides.

With a distance to the front wall 7, further guiding ribs 73*a* and *b* extend in a respectively parallel manner towards the front wall 7 on both sides at the inner wall of magazine housing 3 along the entire length of magazine housing 3. These are aligned towards the rear in the direction of rear wall 9, approximately at a right angle to the inner side of the side walls 5*a* and *b*, and extend forward in the direction towards front wall 7 in an approximately wedge-shaped manner and transfer from there into a further wedge-shaped section 75*a, b* towards the inner side of front wall 7.

In addition to this, on the inner side of front wall 7, a rib 77 is provided that protrudes towards the inside, which extends into the inside of the magazine housing in longitudinal direction over its entire length. Its purpose is the reinforcing of the inner wall of front wall 7 as well as a guiding of feeder 15 as well as of the front side of magazine insert 19. Magazine insert 19 thus features a recess 79 at its front end, which is facing towards front wall 7, and which is approximately complementary to it (compare FIG. 21-23).

The feeder features a recess 81 at its front end (compare FIG. 25-28), which is designed in such a way that the feeder does not rest on rib 77 with its end that is facing towards front wall 7, but that it is merely guided along it at least partially (with corresponding tolerances) when it is moved upwards and downwards within magazine housing 3.

Figure 10:
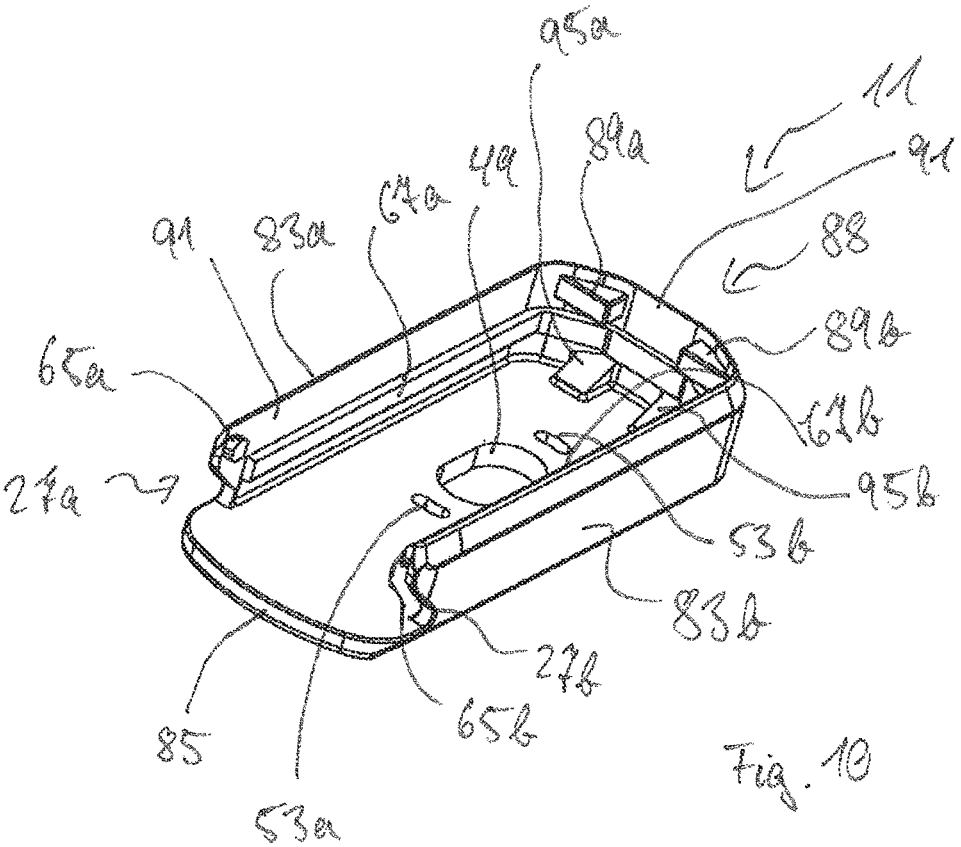
FIG. 10 is perspective view from an angle from the front top of the magazine floor plate of FIG. 1 and FIGS. 3-6.

FIG. 10 shows magazine floor plate 11 in a perspective view from an angle from the upper front. At its front side, magazine floor plate 11 comprises the two respective guiding pins 65*a* and *b* at the upper front end of its lateral guiding sections 83*a* and *b*. Below these, guiding rails 67*a* and *b* extend in longitudinal direction on both respective sides along the entire length of the lateral guiding sections 83*a* and *b*.

Below the guiding pins 65*a* and *b*, the front sides of the lateral guiding sections 83*a* and *b* merge into the counter-guiding and limit stop sections 27*a* and *b* in a wave-shaped manner, which can be brought to rest against the wedge-shaped guiding and limit stop sections 27*a* and *b* of magazine floor plate 11 in the magazine closed position (compare FIGS. 1 and 3-5). The front underside of magazine floor plate 11 extends approximately in a half-round manner, wherein its front edge runs slightly upwards in a sloping manner. A gap is formed between the front edge 85 of magazine floor plate 11 and the front underside of front wall 7 in the magazine closed position for the discharging of fluid, in order to allow e.g. water or other fluid that has entered into magazine 1 to flow out downwardly. In order to magnify this effect, a planar cut-out 87 is provided at the underside of front wall 7 (compare FIGS. 1, 3 and 6) in order to further improve the discharging of fluid.

Approximately in the center of magazine floor plate 11, the oval opening or cut-out 49 is provided in order to engage with the locking tab 51 at magazine insert 19 in the magazine closed position or in the mounted state of the magazine floor plate. The oval-shaped fluid passage openings 53*a* and *b* are provided in longitudinal direction of magazine floor plate 11 before and behind opening 49, which serve the purpose of discharging fluid from magazine housing 3 in addition to the fluid passage slit in the front.

Magazine floor plate 11 is designed approximately in an oval shape, wherein the lateral guiding sections 83*a* and *b* provide a limitation in a U-shape. The two lateral guiding sections 83*a* and *b* merge it each other in a half-round manner at their rear end, which is facing towards rear wall 9. At or inside the inner side of the rear wall or of the rear guiding section 88, respective limit stops for latching 89*a* and *b*, which are approximately triangular-shaped, are formed on both sides within the rounded edges of magazine floor plate 11, which extend roughly at a right angle, within approximately the upper third of the inner wall 91 of magazine floor plate 11. These limit stops for latching 89*a* and *b* are provided in a complementary way with regards to the latching cut-outs 64*a* and *b* that are formed on both sides on the lower side of rear wall 9 of magazine housing 3 (compare FIGS. 15, 16 and 18). When magazine floor plate 11 is closed, latching cut-outs 64*a* and *b* are engaged with the limit stops for latching 89*a* and *b*.

From the inner side of the rear wall or of the rear guiding section 88, two further guiding sections 95*a* and *b* extend in a wedge-shaped manner in longitudinal direction of magazine floor 11 into the direction of recess 49. On the one hand, the guiding sections 95*a* and *b* have the function of reinforcing the rear edge section of magazine floor plate 11 in the area of rear wall 88, which increases the longevity and durability of magazine 1 in particular during a fall test, which is required nowadays for bidding. Furthermore, the guiding sections 95*a* and *b* engage with a counter guiding section 55, which is also formed in a complementary wedge-shaped manner, when magazine floor plate 11 is moved into its closed position. Magazine floor plate 11 and the counter guiding section 55 are hereby braced against each other.

At the upper side of magazine floor plate 11, the lateral guiding sections 83*a* and *b*, as well as the connecting rear wall 88 are chamfered towards the top. Such chamfered edges prevent sharp-edged ledges, which can get caught and which are difficult to clean.

Figure 11:
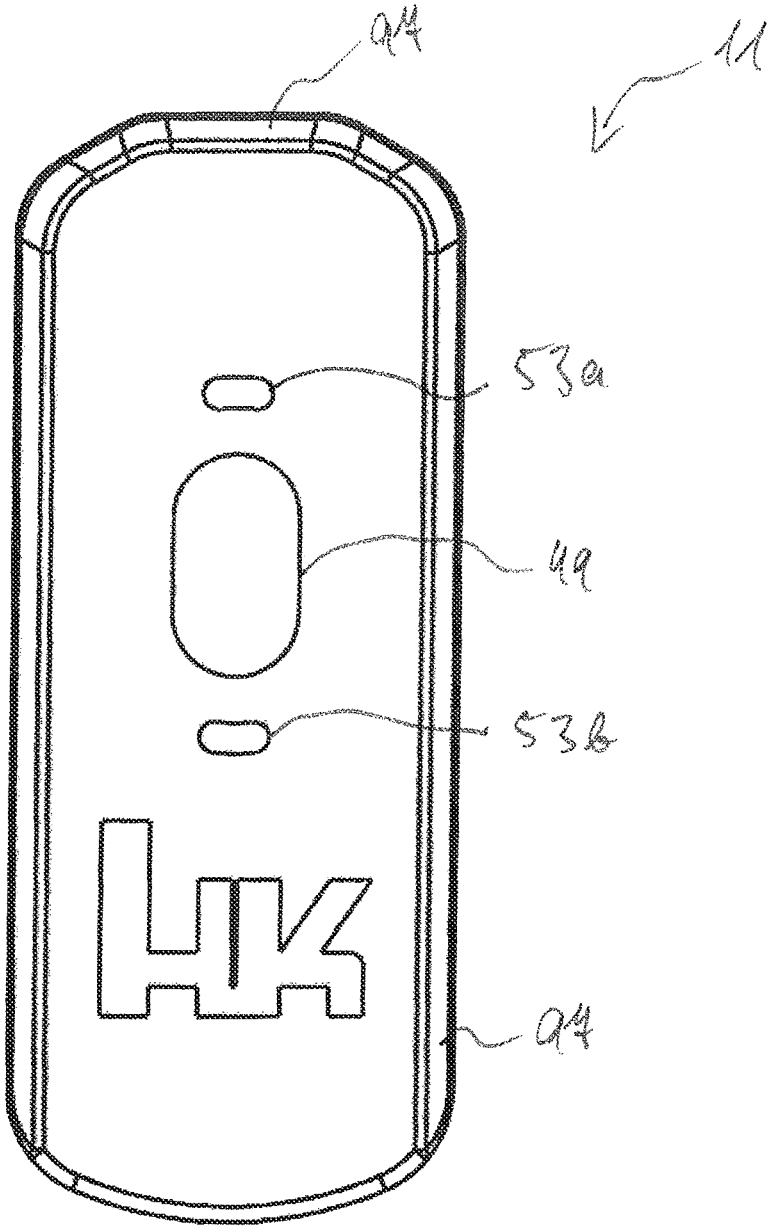
FIG. 11 is a perspective view from below of the magazine floor plate of FIG. 10.

FIG. 11 shows magazine floor plate 11 with its oval opening 49 and the two fluid passage openings 53*a* and *b* from below. The lower circumferential edge 97 of the magazine floor is also designed in a chamfered manner.

Figure 12:
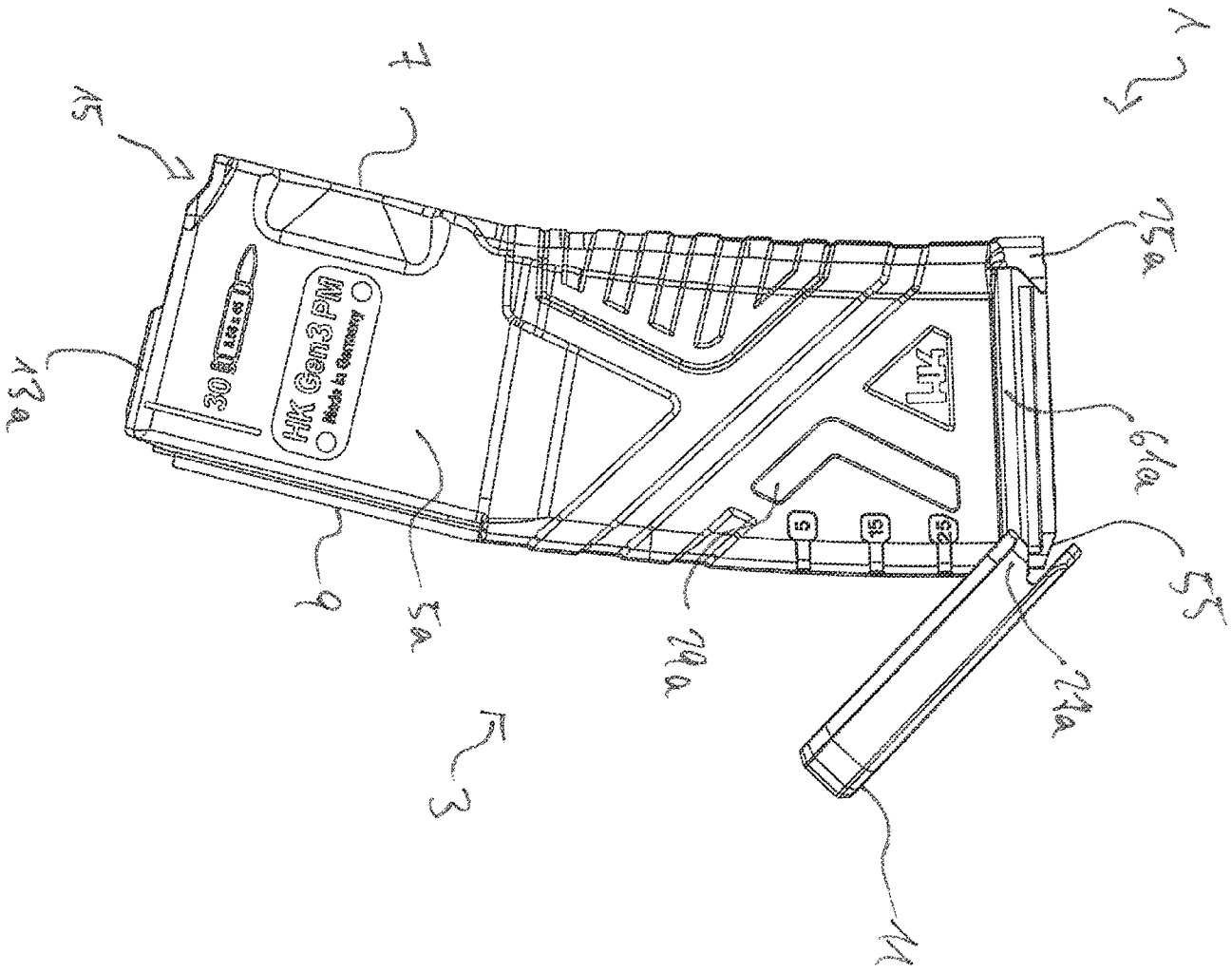
FIG. 12 is a side view of the upside-down magazine of FIG. 1 and FIGS. 3-6 with a magazine floor plate that is pivoted at a 45° angle.

FIG. 12 shows magazine floor plate 11 in its magazine opening position or demounted position, in which it is completely pushed towards the back, and additionally pivoted upwardly by approximately 45° in the direction of the magazine housing. Guiding pins 65*a* and *b* are situated in their rear limit stop position within the guiding grooves 61*a* and *b*, in which the dual-sided limit stop 62*a* and *b* prevents a further shifting of magazine floor plate 11 towards the rear. In this position, the guiding rails 67*a* and *b* are disengaged on the inner wall of the lateral guiding sections 83*a* and *b* from the guiding grooves 59*a* and *b* that are open towards the rear, which allows the pivoting movement of magazine floor plate 11. Guiding pins 65*a* hereby function as the pivoting axis. In addition to this, it becomes apparent that the wedge-shaped section 55 is necessary for the pivoting of magazine floor plate 11.

Figure 13:
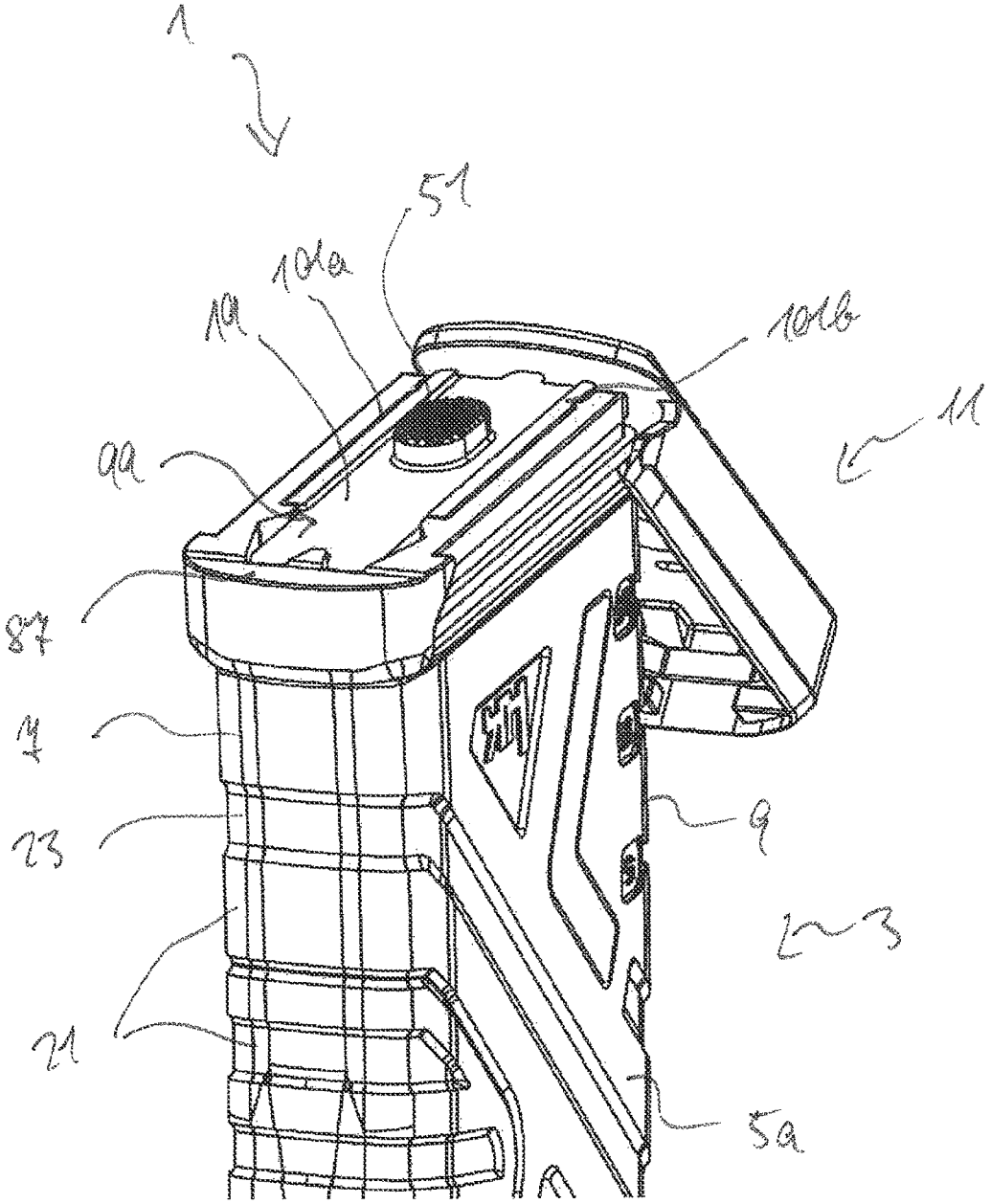
FIG. 13 is a perspective view from an angle from the front of the magazine of FIG. 12.

FIG. 13 shows a perspective depiction of magazine floor plate 11, which is pivoted upwards by 45°, and of magazine insert 19, which is inserted into magazine housing 3. In this position, magazine insert 19 would have to be held back, since magazine spring 17 would otherwise push it out downwards, of magazine housing 3. Magazine catch 51 is formed in a complementary way with regards to the cut-out or oval opening 49 in magazine floor plate 11. On its underside, the surface of locking tab 51 is equipped with a knob-like structure, which serves as an anti-slip surface and which makes it possible that it can e.g. be used by a shooter under difficult conditions and/or with gloves.

Ribs 101*a* and 101*b* extend on both sides in longitudinal direction on the underside 99 of magazine insert 19, between which a planar deepening 103 extends over the remaining underside of magazine insert 19. In the closed magazine position, the inner side of magazine floor plate 11 rests on the guiding bars or ribs 101*a* and *b*, so that a gap is formed across the remaining surface of the underside of magazine insert 19. This makes it possible that fluid can be drained out from the inside of magazine housing 3 and to discharge it out of magazine 1 via the two fluid passage openings 53*a* and *b*, as well as the slit between the front edge 85 of magazine floor plate 11 that was formed by the planar cut-out 87 at the underside of front wall 7 of magazine housing 3 (compare FIGS. 3, 6, 8, 14 and 15).

Figure 14:
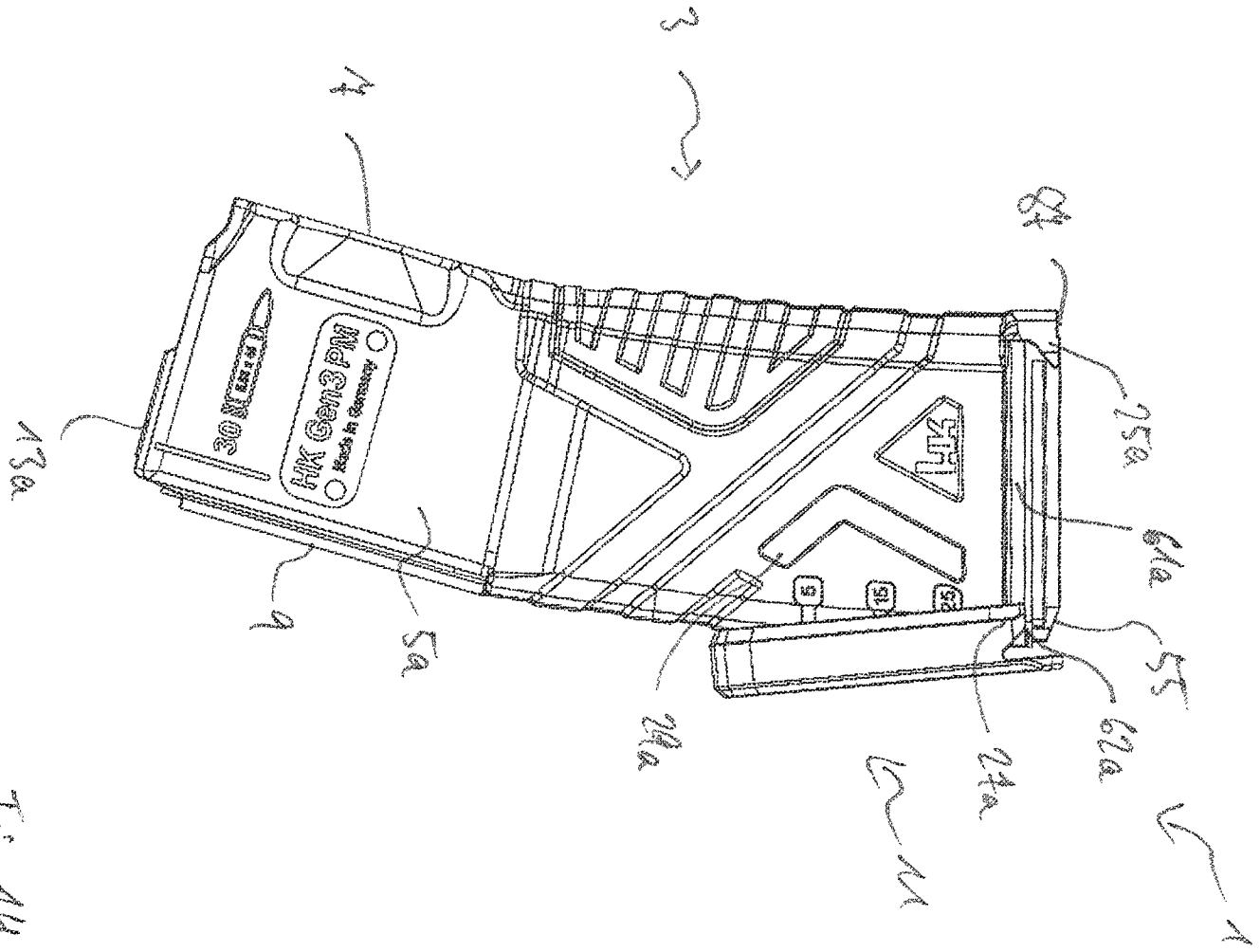
FIG. 14 is a side view of the magazine of FIG. 12 with a completely pivoted magazine floor plate.

FIG. 14 shows the completely pivoted or folded away magazine floor plate 11, which rests against the rear wall 9 of magazine housing 3. Magazine housing 3 or its rear wall 9 thus provides a limit stop and limits the motion radius of the magazine floor plate.

Figure 15:
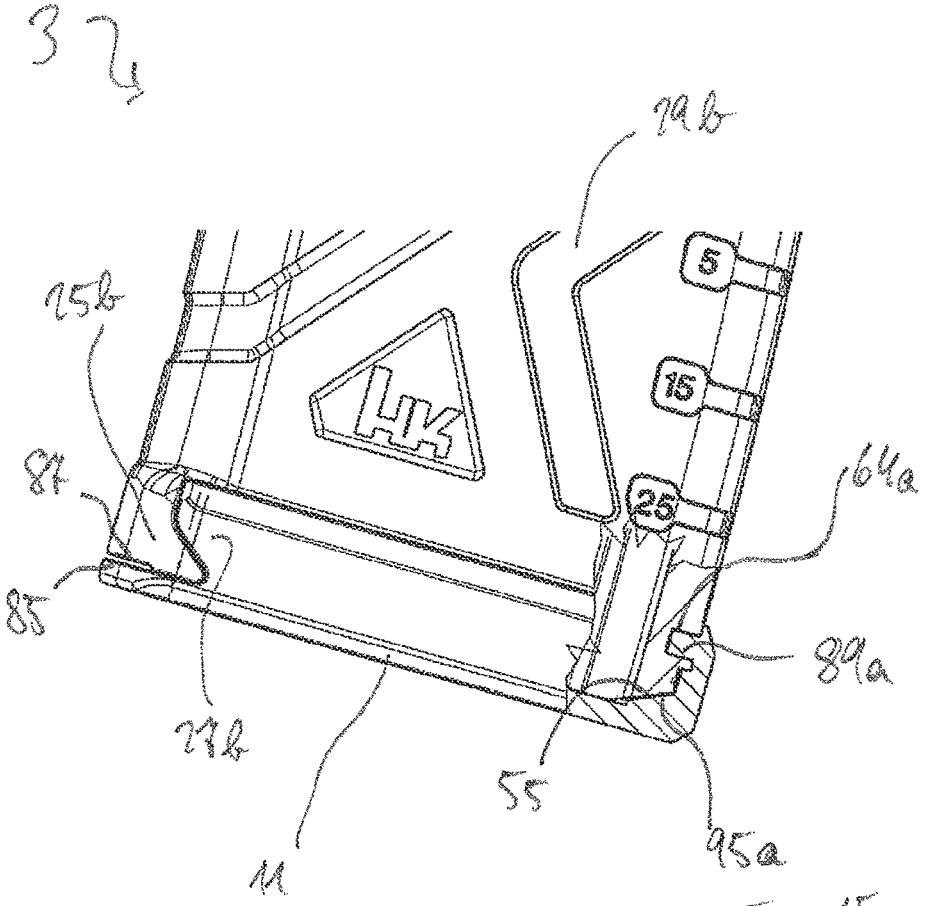
FIG. 15 is a perspective sectional view of the magazine of FIGS. 12-14 with a partial section through a rear end section of the magazine floor plate.
Figure 16:
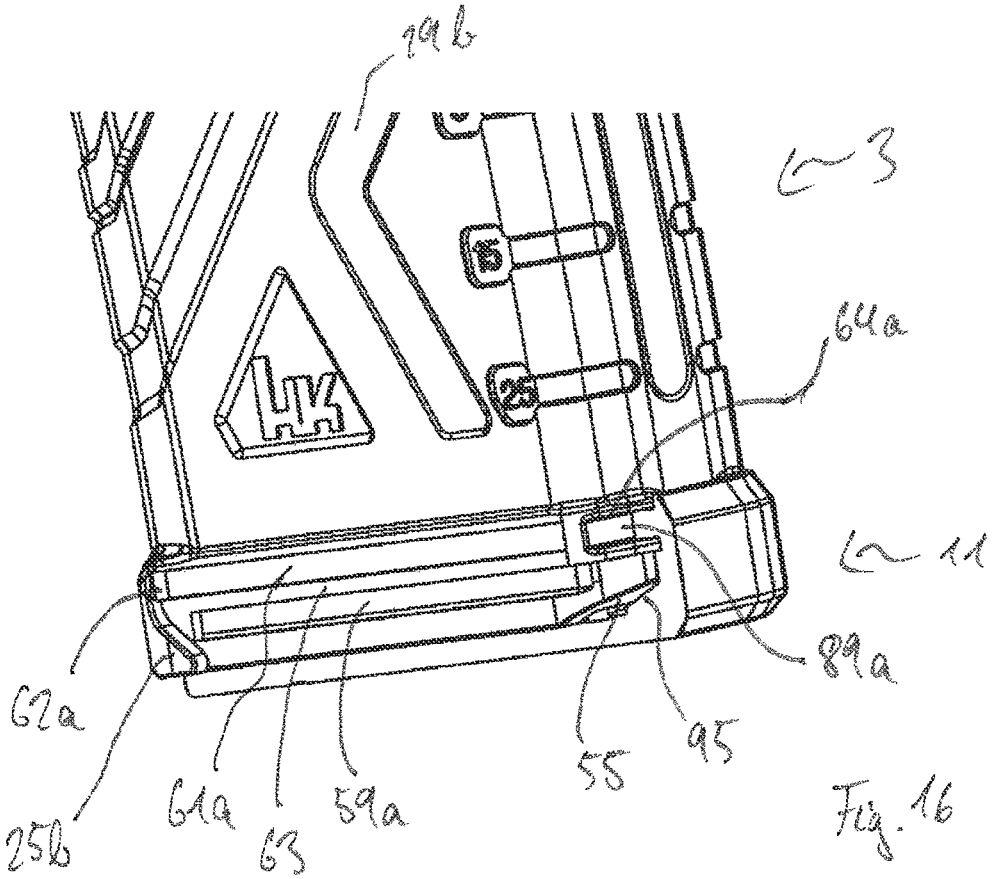
FIG. 16 is a perspective view of the magazine of FIGS. 12-14 with a longitudinal section through the magazine floor plate.

FIG. 15 shows an enlarged detailed depiction of magazine floor plate 11 in its closed position, wherein the limit stop for latching 89*a* is shown in its engaged position with the latching cut-out 64*a* in rear wall 9. Likewise, it is depicted in a sectional cut how the wedge-shaped guiding section 95*a, b* rests at the counter guiding section 55 at the underside of rear wall 9. This can also be derived from FIG. 16, in which magazine floor plate 11 is shown in a longitudinal sectional cut.

Figure 17:
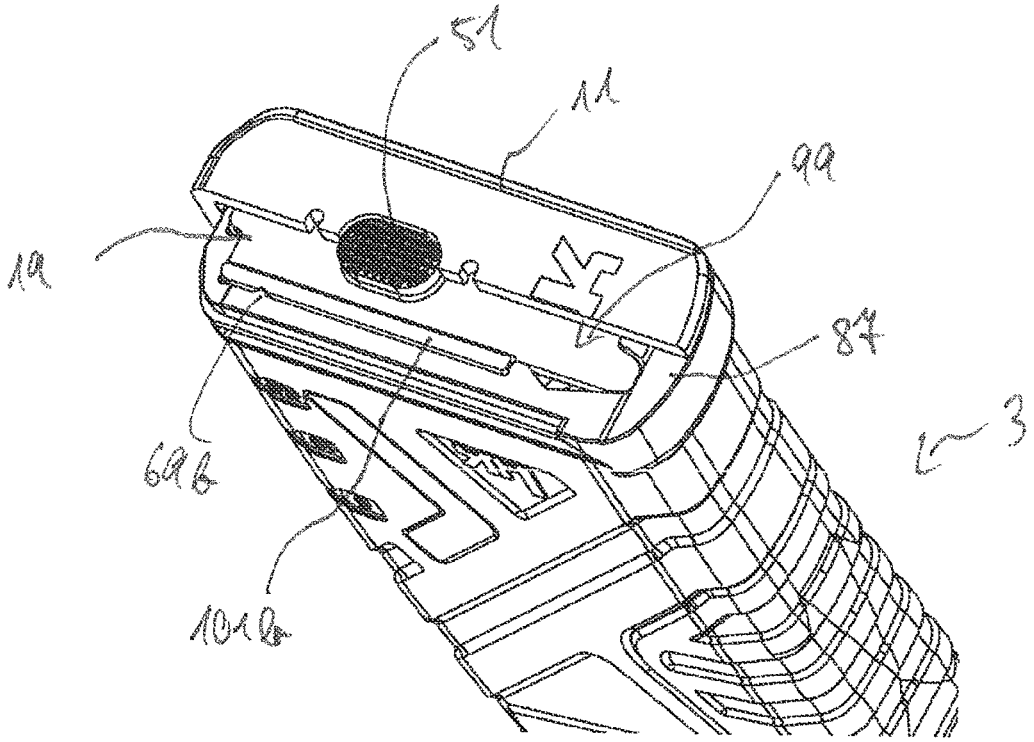
FIG. 17 is another perspective view of the magazine of FIGS. 12-14 with a longitudinal sectional view of the magazine floor plate.
Figure 18:
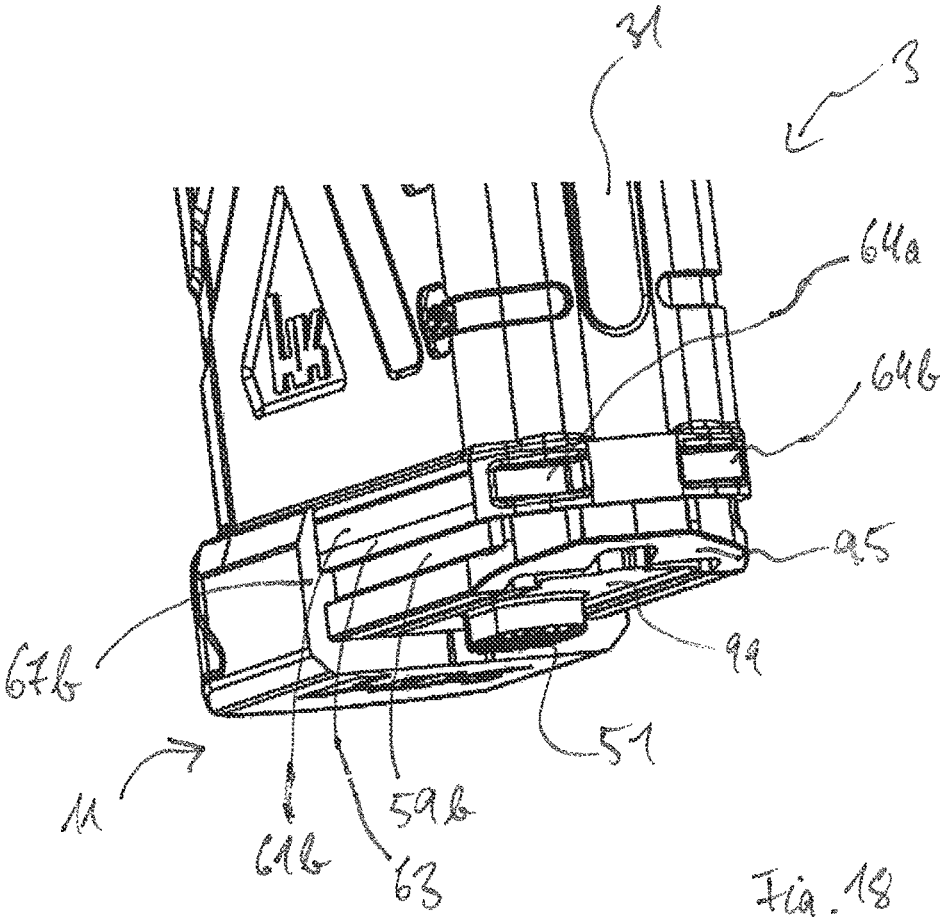
FIG. 18 is a perspective view from an angle from the rear left of the magazine of FIGS. 12-14 with a transverse sectional cut through the magazine floor plate.

FIG. 17 shows a further perspective depiction with a magazine floor plate 11 being cut in longitudinal direction approximately in the center. FIG. 18 shows a perspective depiction with magazine floor plate 11 being partially cut in transverse direction.

Figure 19:
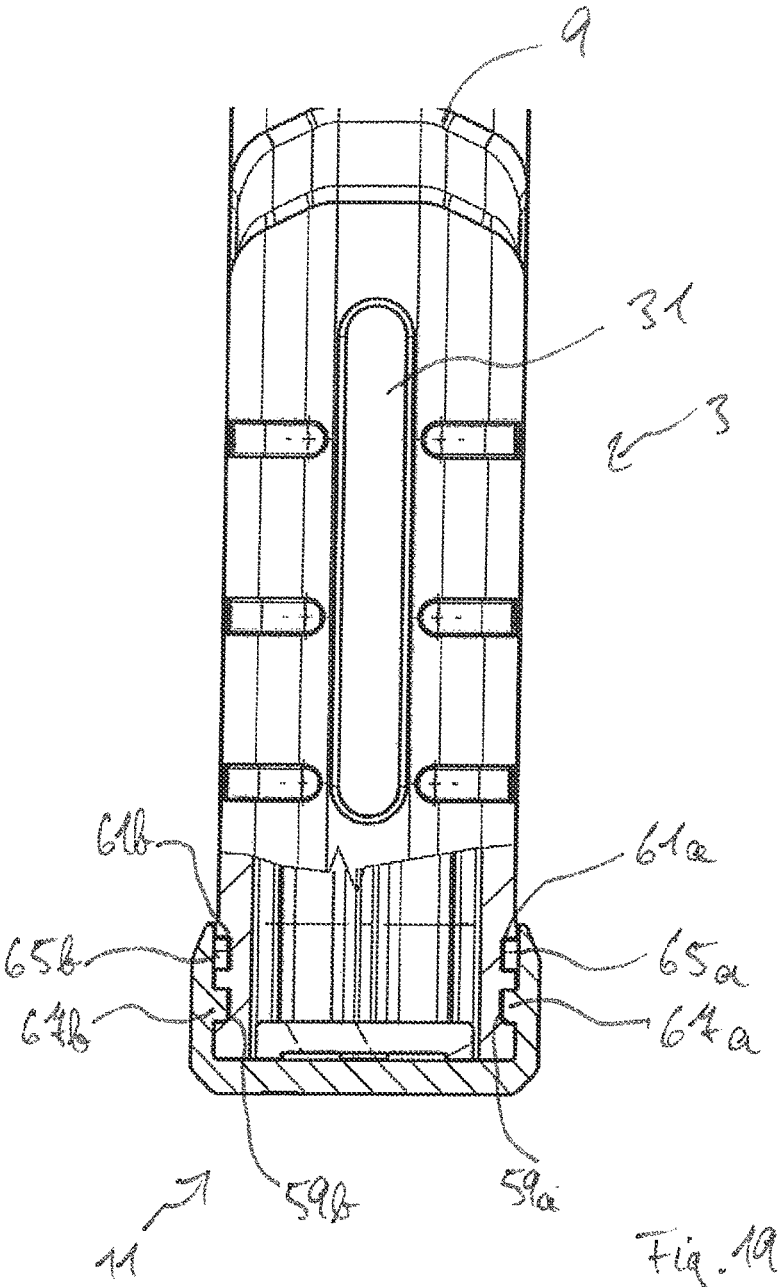
FIG. 19 is a perspective view from the rear of the magazine of FIGS. 12-14 with a partial section through a lower part of the magazine housing and the magazine floor plate.

FIG. 19 shows a further depiction with magazine floor plate 11 being partially cut in transverse direction, wherein the guiding pins 65*a* and *b* are placed in the guiding recesses or guiding grooves 61*a* and *b* and the guiding rails 67*a* and *b* are respectively located inside the guiding grooves 59*a* and *b*.

Figures 3, 20:
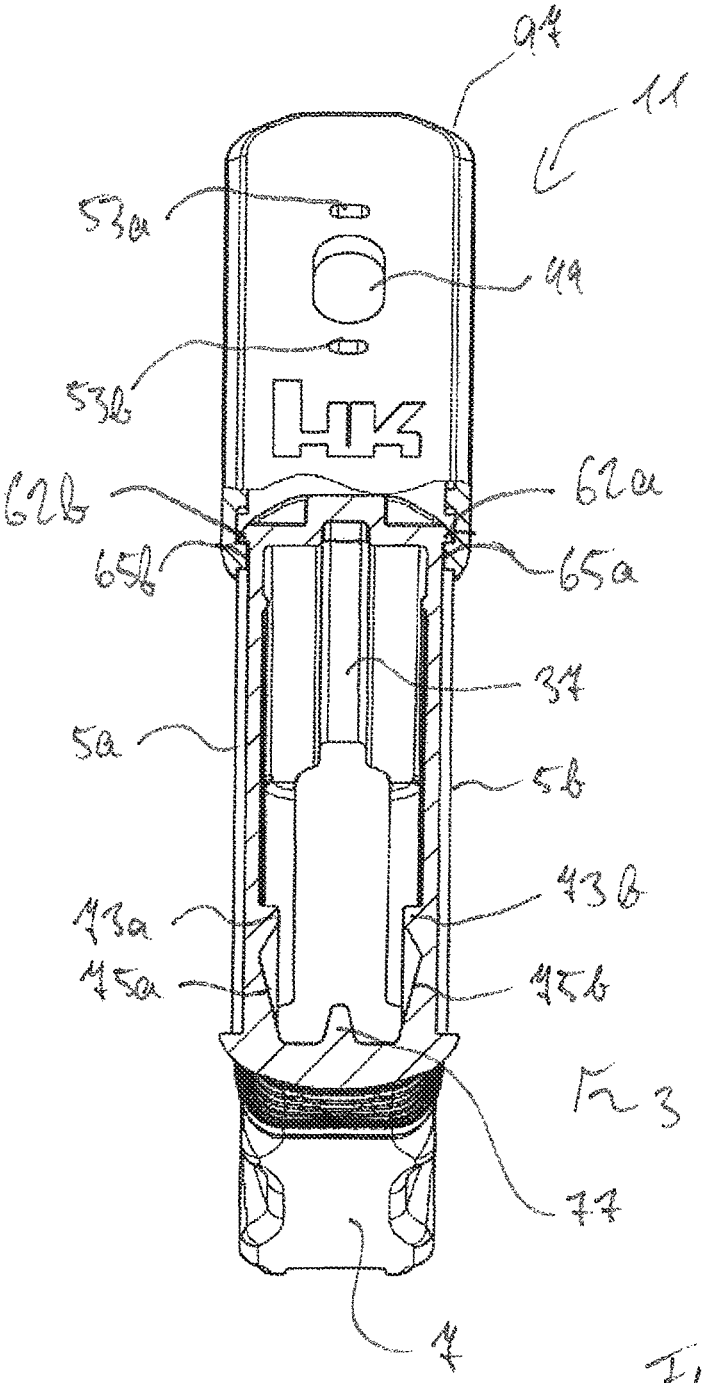
FIG. 20 is a perspective view from an angle from the lower front of the magazine of FIGS. 12-14 with a longitudinal section through the magazine housing and a partial front section of the magazine cover.

FIG. 20 shows magazine housing 3 with a cross-section through the underside of magazine housing 3 and a partial cross-section through the lateral guiding sections in the front of magazine floor plate 11 through the hinge pins or guiding pins 65*a* and *b* from below.

Figure 21:
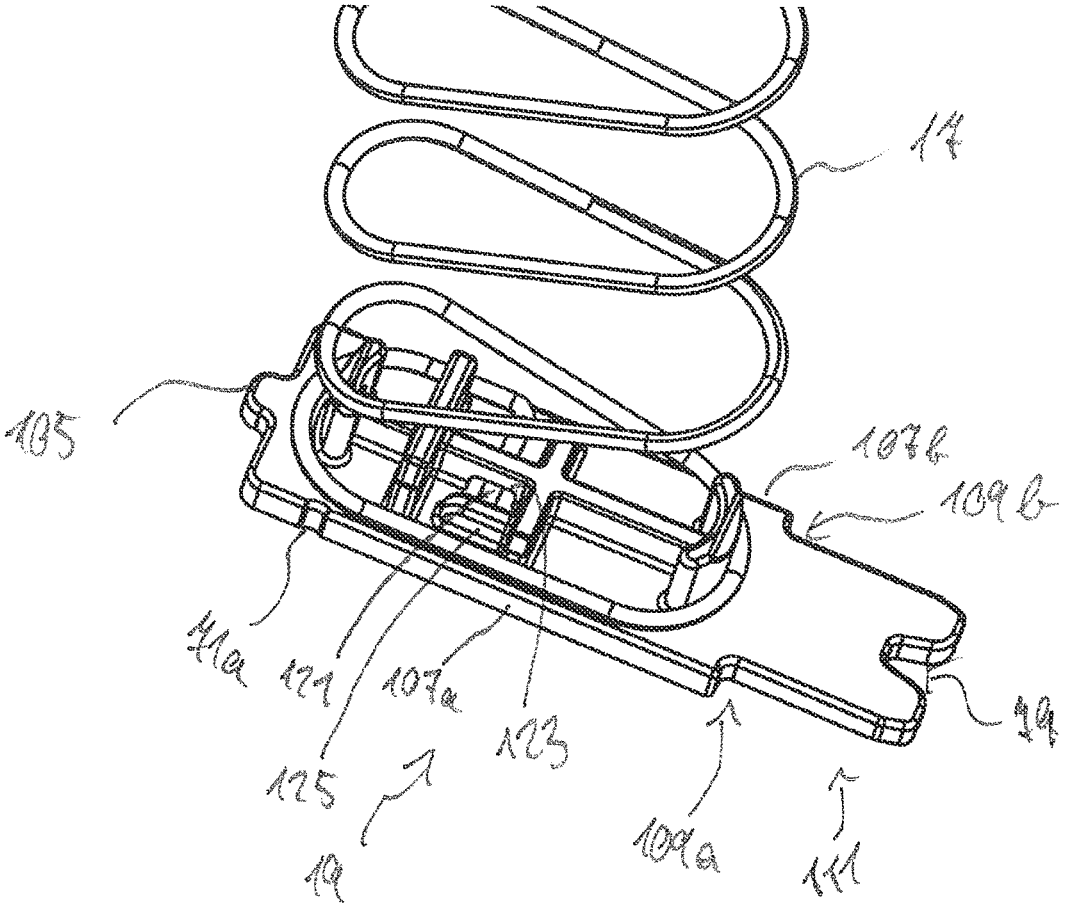
FIG. 21 is a perspective view from the upper front of a magazine insert coupled to a magazine spring.
Figure 22:
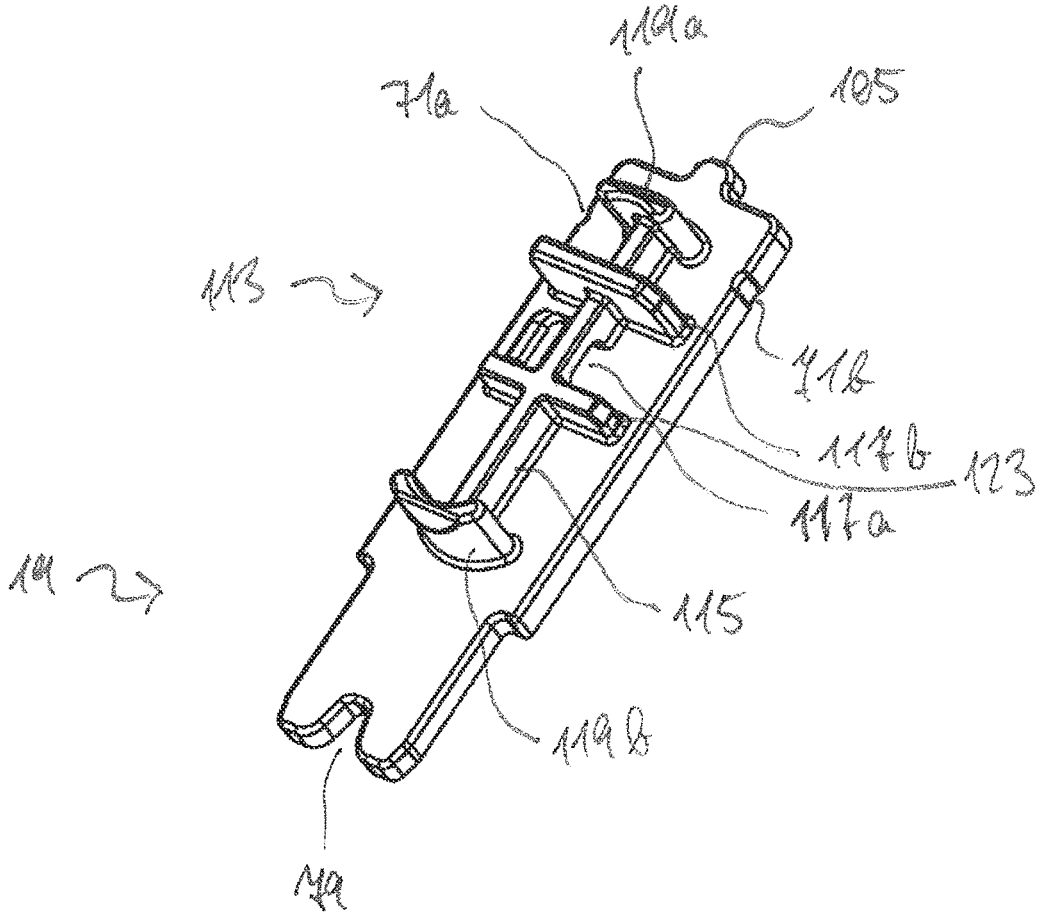
FIG. 22 is a perspective view from an angle from the upper front of the magazine insert of FIG. 21.

FIG. 21 shows an enlarged depiction of magazine insert 19 which is coupled with magazine spring 17. The outer dimensions of magazine insert 19 are approximately formed in a complementary manner with regards to the inner dimensions of magazine housing 3, or of magazine shaft 10. Magazine insert 19 is basically formed in a rectangular and plate-shaped manner. At its rear end, a guiding extension 105 protrudes approximately from the center, which is guided within the guiding recess 37 in rear wall 9 of magazine housing 3. The rear side of magazine insert 19 merges via rounded corners into side edges 107*a, b*, which extend parallel towards each other. These are penetrated in their rear section by half-round guiding recesses 71*a* and *b*, which in turn are provided for the described guiding along the guiding ribs 69*a, b* at the inner side of the side walls 5*a, b* of magazine housing 3.

Towards the front end, magazine insert 19 narrows within approximately the front quarter and forms two ledges 109*a, b* there, which are roughly provided in a complementary way with regards to the guiding ribs 73*a, b* at the inner side of the side walls 5*a, b* of magazine housing 3 (compare FIGS. 8, 13, 17 and 20). The subsequently narrowed guiding section 111 of magazine insert 19 includes at its front side the front cut-out or recess 79 approximately in the center, which is provided in a complementary manner with regards to guiding rib 77 at the inner side of front wall 7 of magazine housing 3.

On the upper side of magazine insert 19, a holding structure 113 extends upwards (compare FIG. 22) in order to couple with magazine spring 17. This holding structure 113 is provided in one piece at magazine insert 19 and includes a longitudinal rib 115 that extends in longitudinal direction of magazine insert 19 with two transverse ribs 117*a, b* that extend in transverse direction with regards to the longitudinal direction of magazine insert 19. The longitudinal rib 115 is limited by rounded limiting bars 119*a, b* on both sides.

Holding structure 113 is dimensioned approximately in a complementary manner with regards to magazine spring 17, so that the first coil of magazine spring 17 grips around the two limiting bars 119*a* and *b* (compare FIG. 21, 22 24). The end 121 of magazine spring 17 is roughly bent at a right angle and reaches through a passage 123, which is formed at the underside of the longitudinal rib 115 between the two transverse ribs 117*a* and *b*. On the side of the longitudinal rib 115, which is opposite to spring end 121, a limiting bar 125 is formed that reaches upwards, which extends the transverse rib 117*a* approximately at a right angle towards the rear. The limiting bar 125 provides a border for the inserting depth of the end 121 of magazine spring 17.

Figure 23:
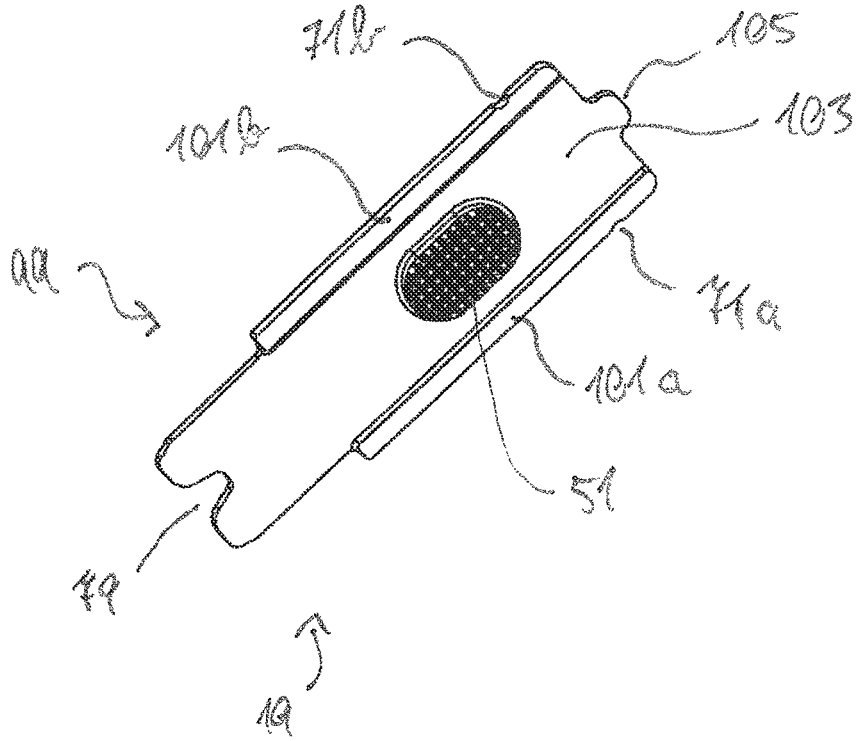
FIG. 23 is a perspective view from the lower front of the magazine insert of FIG. 22.

FIG. 23 shows a perspective depiction of the underside 99 of magazine insert 19. Approximately in the center, the oval locking tab 51 protrudes downwards, which is provided for the latching with opening 49 in magazine floor plate 11. Between the ribs 101*a* and *b* on both sides, the described planar deepening 103 is provided for the discharging of fluid.

Figure 24:
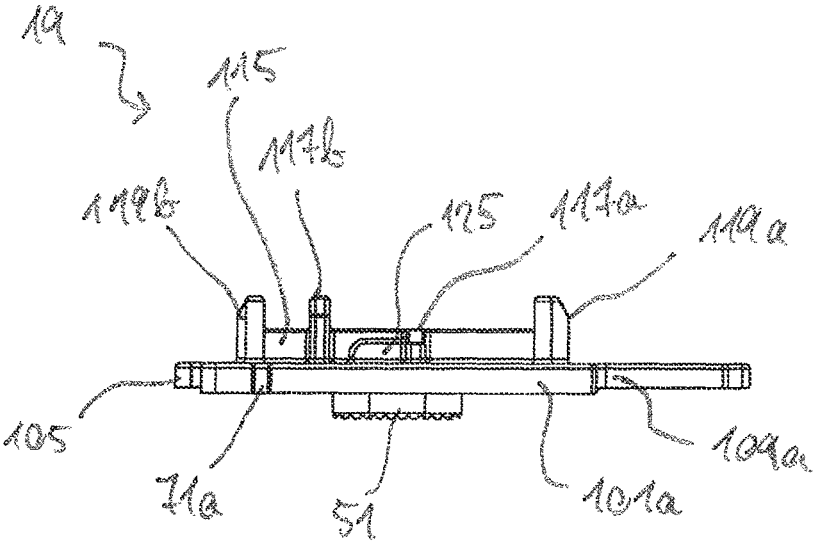
FIG. 24 is a side view from the right of the magazine insert of FIGS. 22-23.
Figure 25:
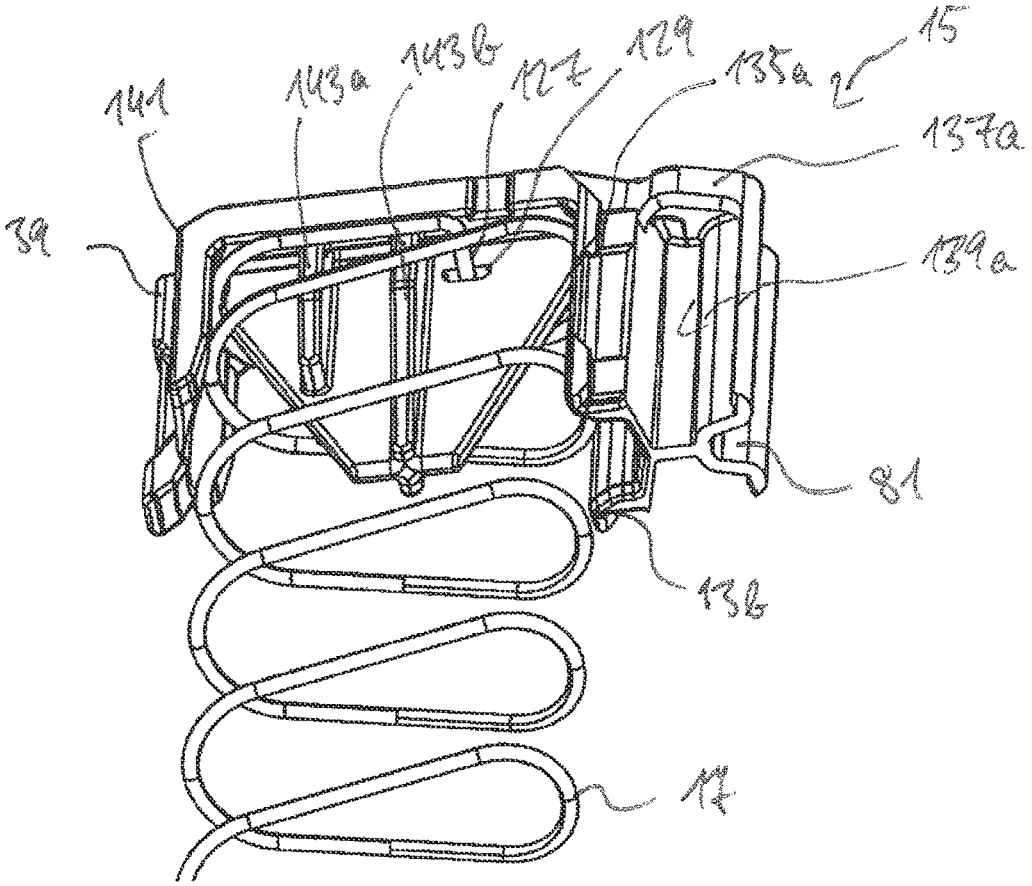
FIG. 25 is a perspective front view from below of the feeder of FIG. 2 coupled to the spring.
Figure 26:
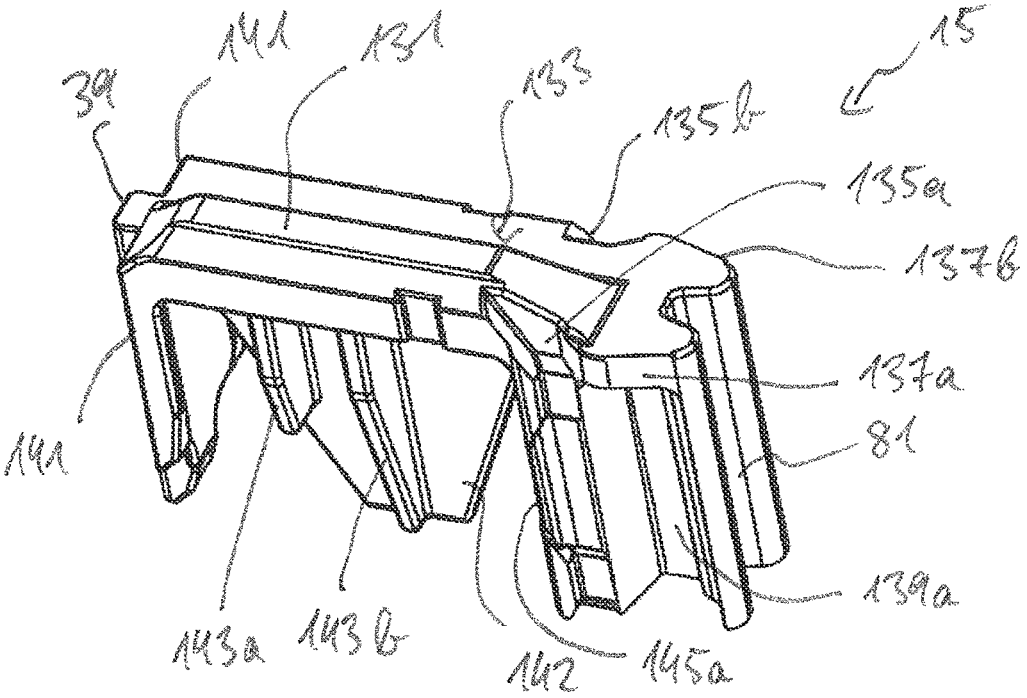
FIG. 26 is a front view from an angle from above of the feeder of FIG. 25.
Figure 27:
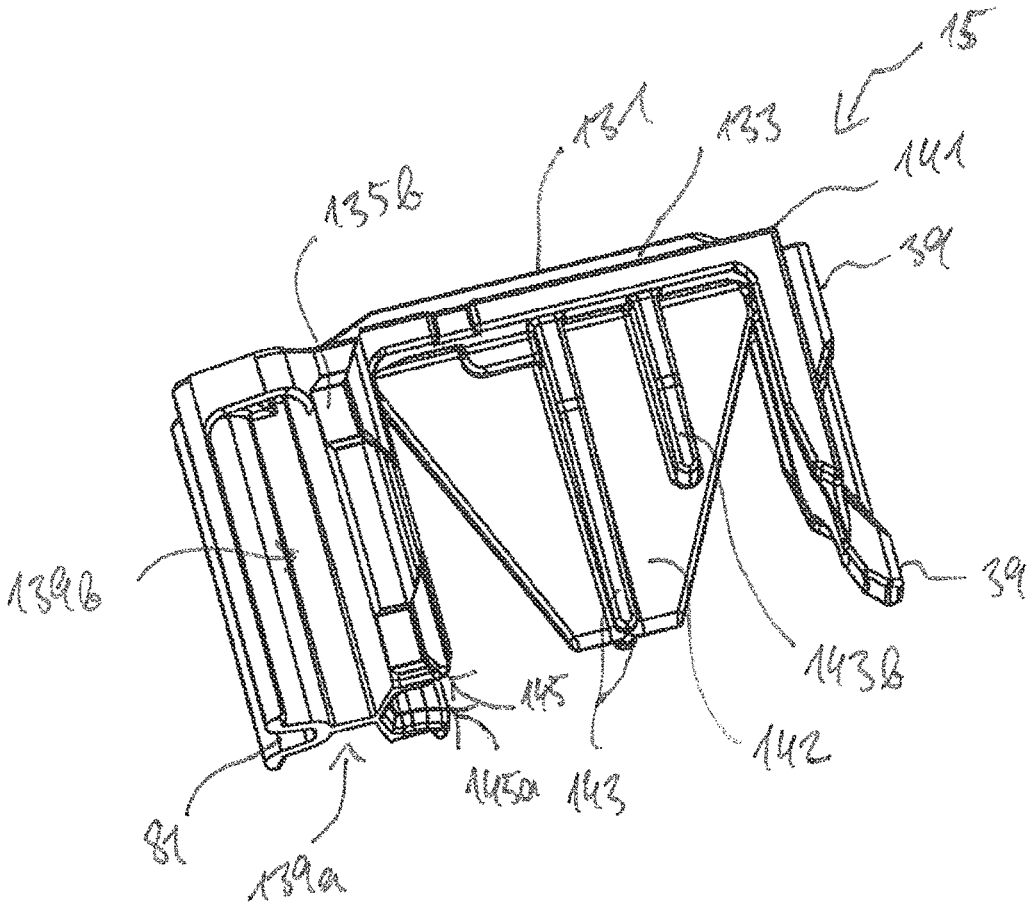
FIG. 27 is a perspective view from an angle from below of the feeder from FIGS. 25-26.
Figure 28:
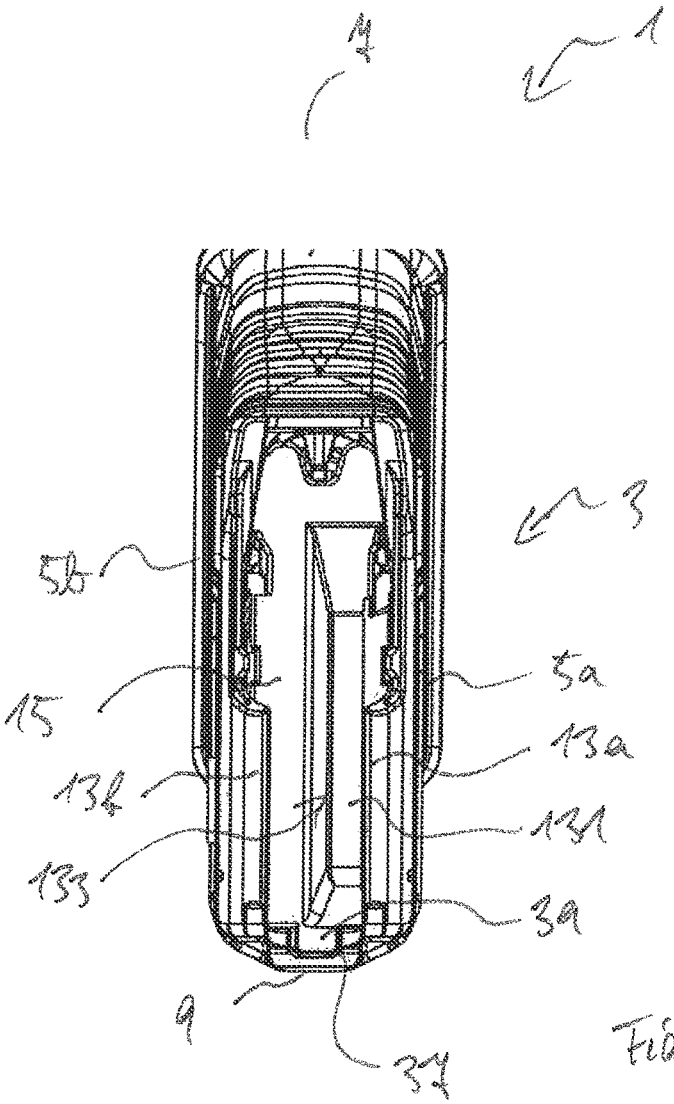
FIG. 28 is a perspective top view of the magazine with the inserted feeder.

FIG. 24 shows a side view of magazine insert 19 from the right side. FIG. 25 shows feeder 15 that is coupled with magazine spring 17. In FIGS. 26 and 27, feeder 15 is shown in two perspective detailed depictions (in FIG. 26 from the right side, in FIG. 27 from the left side) and in FIG. 28, feeder 15 is shown as it is inserted into magazine housing 3 in a top view from above.

For the coupling of magazine spring 17 with feeder 15, the upper end section 127 of magazine spring 17 is bent approximately at a right angle towards the inside and reaches through a loop 129 that is provided in feeder 15. Feeder 15 is designed as a one-piece molding, which features approximately a rectangular-shaped cross-section in top view and whose dimensions are intended to be approximately complementary with regards to the inner dimensions of magazine housing 3. At the upper side of the feeder, an elevation 131 (e.g., a spacer) is provided which extends approximately over the entire longitudinal direction, roughly corresponding to the length of a cartridge case, which forms at its inner side a support surface 133 for a cartridge that is located there (not depicted). As it was described, the cartridges are stored in magazine housing 3 in a known zigzag-like manner. The lowest cartridge is thus located on the left side next to support surface 133 of elevation 131. The next cartridge is placed on elevation 131, it is thus shifted to the right side when compared to the first cartridge and basically rests on elevation 131 and partially on the first cartridge (not shown). This configuration of the feeder surface ensures a constant cartridge feeding from magazine housing 3.

The front side of feeder 15 comprises the described cut-out or recess 81 in front, which, however, does not rest on the longitudinal rib 77 on the inside of the front wall 7 of magazine housing 3. Instead, right-angled counter guiding sections 135*a* and *b* extend downwards, which rest on the longitudinal ribs 73*a* and *b* that are provided on both sides within magazine housing 3, more precisely on the inner sides of the side walls 5*a* and *b*. The height of feeder 15 roughly corresponds to ⅔ of its length.

The front outer sides 137*a, b* of feeder 15 are largely cut-out by recesses 139*a* and *b* downwardly and inwardly. On the one hand, this measure has the purpose to reduce weight and, on the other hand, addresses any obstructions of the movement of the feeder within magazine housing 3 due to dirt. Any dirt that has entered into the magazine shaft, such as sand, dust, etc. does not have to be displaced—it also reduces a frictional resistance in the area of the recesses 139*a, b* and thus the overall frictional resistance.

At the rear end of feeder 15, the rib-like guiding formation 39 extends downwards, which is provided to engage with the guiding recess 37 at the inner side of rear wall 9 of magazine housing 3 (see. also FIGS. 8 and 9 as well as 26-28). Rib 39 is not formed in a continuous manner, but it is penetrated by means of a tapering. This measure serves to reduce any frictional forces and to provide a 2-point guiding.

The lower end of rear side 141 of feeder 15 tapers approximately in the lower quarter to the thickness of guiding rib 39. Between the rear side 141 and approximately of the area of the counter guiding surfaces 135*a, b*, feeder 15 is designed to be open downwards. In this area, approximately in the center with reference to the longitudinal direction of feeder 15, a reinforcing and stabilizing surface 142 extends in approximately a trapezoid-shaped manner downwards. The height of this surface corresponds to approximately ⅔ of the length of feeder 15. The trapezoidal- or approximately triangular-shaped formation of this surface corresponds in its dimensions to the lower side of feeder 15, approximately to the inner diameter of one coil of magazine spring 17.

In transverse direction of feeder 15, reinforcing ribs 143*a* and *b* that are extending downwards are provided on both sides of the triangular surface, which serve on the one hand for a stabilization and on the other hand for a holding of a further, in particular compressed coil of magazine spring 17. As it can be particularly seen from FIG. 26, the reinforcing ribs 143*a* and *b* taper in the direction of the lower end of the reinforcing and stabilizing surface 142. By means of this measure, the coils of magazine spring 17 can be pushed onto the reinforcing and stabilizing surface 142 in an easier manner when they are compressed. The respective inner side of the rear side 141 as well as the inner side 145*a, b* of the counter guiding surfaces 135*a* and *b* correspond in their dimensions approximately to the outer diameter of the coils of magazine spring 17. Further embodiments of the disclosure can be derived by an expert from the dependent claims and from the following drawings.

It is noted that this patent claims priority from DE Patent Application Serial Number 10 2017 010 908.7, which was filed on Nov. 24, 2017, and is hereby incorporated by reference in its entirety.

What is claimed is:

1. A magazine for a self-loading firearm, the magazine comprising:

a magazine housing; and a magazine floor plate movably mounted to the magazine housing, the magazine floor plate slidable and not pivotable when the magazine floor plate is between an open position and a closed position and when the magazine floor plate is in the closed position;

wherein the magazine floor plate is pivotable relative to the magazine housing when in the open position, a spring in the magazine housing accessible when the magazine floor plate is in the open position.

2. The magazine according to claim 1, further including at least one safety element to secure the magazine floor plate from decoupling from the magazine housing.

3. The magazine according to claim 1, further including at least two hinge pins formed on opposite sides of one of the magazine floor plate or the magazine housing, the at least two hinge pins defining a pivot axis associated with the magazine floor plate.

4. The magazine according to claim 3, wherein the at least two hinge pins are coupled to a guideway to allow the magazine floor plate to at least move or pivot relative to the magazine housing, and wherein at least one of the magazine housing or the magazine floor plate includes the guideway.

5. The magazine according to claim 4, wherein the guideway includes at least one limit stop element to limit a motion path of the at least two hinge pins.

6. The magazine according to claim 1, wherein the magazine floor plate includes a ramped actuating section to support the magazine floor plate against a counter section when moving between the open position and the closed position, a lower side of the magazine housing including the counter section.

7. The magazine according to claim 1, wherein the magazine floor plate includes at least one locking element to enable the magazine floor plate to at least one of lock or unlock with at least one complementary counter latch when the magazine floor plate moves between the open position and the closed position, a lower side of the magazine housing including the at least one complementary counter latch.

8. The magazine according to claim 1, wherein at least one of the magazine housing or the magazine floor plate includes at least one fluid passage opening.

9. The magazine according to claim 8, wherein a lower side of the magazine housing includes at least one recess defining the at least one fluid passage opening between the magazine housing and the magazine floor plate.

10. The magazine according to claim 1, wherein the magazine housing further includes a magazine shaft, an inner side of a rear wall of the magazine shaft including at least one guiding section to guide at least one counter-guiding element, and wherein at least one of a magazine insert or a feeder includes the at least one counter-guiding element.

11. The magazine according to claim 10, wherein at least one of an inner side wall or a front wall of the magazine shaft includes at least one guiding element to guide at least one of the magazine insert or the feeder.

12. The magazine according to claim 10, wherein the feeder and the magazine insert are coupled via the spring, the feeder and magazine insert maintaining a pre-loaded orientation when the magazine floor plate is in the closed position.

13. The magazine according to claim 10, wherein a lower side of the magazine insert includes a locking tab to couple with a recess associated with the magazine floor plate to retain the magazine floor plate in the closed position.

14. The magazine according to claim 13, wherein the lower side of the magazine insert includes an at least partially deepened section.

15. The magazine according to claim 10, wherein front outer sides of the feeder include at least one recess.

16. The magazine according to claim 10, wherein an upper side of the feeder includes at least one spacer.

17. The magazine according to claim 1, wherein the magazine housing includes at least one of a cut-out or a viewing insert to determine a loading state of the magazine housing.

18. A magazine including a magazine floor plate, the magazine comprising:

a magazine housing movably mounted to the magazine floor plate, the magazine floor plate slidable and not pivotable when the magazine floor plate is between an open position and a closed position and when the magazine floor plate is in the closed position, the magazine floor plate pivotable relative to the magazine housing when in the open position, a spring in the magazine housing accessible when the magazine floor plate is in the open position.

19. A self-loading firearm comprising:

a magazine housing; and a magazine floor plate movably mounted to the magazine housing, the magazine floor plate slidable and not pivotable when the magazine floor plate is between an open position and a closed position and when the magazine floor plate is in the closed position;

wherein the magazine floor plate is pivotable relative to the magazine housing when in the open position, a spring in the magazine housing accessible when the magazine floor plate is in the open position.

* * * * *